US012757999B2

(12) United States Patent
Lee et al.

(10) Patent No.: US 12,757,999 B2
(45) Date of Patent: Oct. 13, 2026

(54) CONTENT CONTAINER

(71) Applicant: YONWOO CO., LTD., Incheon (KR)

(72) Inventors: Jin Sung Lee, Seoul (KR); Jung Mo Jung, Seoul (KR); Young Min Choi, Seoul (KR); Sung Bong Kye, Seoul (KR); Sang Geun Han, Seoul (KR)

(73) Assignee: YONWOO CO., LTD., Incheon (KR)

( * ) Notice: Subject to any disclaimer, the term of this patent is extended or adjusted under 35 U.S.C. 154(b) by 28 days.

(21) Appl. No.: 18/853,254

(22) PCT Filed: Mar. 30, 2023

(86) PCT No.: PCT/KR2023/004242
§ 371 (c)(1),
(2) Date: Oct. 1, 2024

(87) PCT Pub. No.: WO2023/191527
PCT Pub. Date: Oct. 5, 2023

(65) Prior Publication Data

US 2025/0366596 A1 Dec. 4, 2025

(30) Foreign Application Priority Data

Apr. 1, 2022 (KR) ..... 10-2022-0041308
Nov. 10, 2022 (KR) ..... 10-2022-0149840
Nov. 10, 2022 (KR) ..... 10-2022-0149856

(51) Int. Cl.
*A45D 40/20* (2006.01)
*A45D 40/00* (2006.01)

(52) U.S. Cl.
CPC ..... *A45D 40/20* (2013.01); *A45D 2040/0012* (2013.01)

(58) Field of Classification Search
CPC ..... A45D 40/20; B43K 19/145; B43K 23/016
USPC ..... 401/96–97
See application file for complete search history.

(56) References Cited

U.S. PATENT DOCUMENTS 4,267,929 A * 5/1981 Korterod ..... B65D 51/24 220/267
4,545,983 A 10/1985 Russ et al.
2001/0007623 A1 7/2001 Sugarman

FOREIGN PATENT DOCUMENTS

JP H07275033 A * 10/1995
JP 2741097 B2 4/1998
JP 2001-192502 A 7/2001
JP 2002-017441 A 1/2002
KR 20-1985-0009962 U 12/1985
KR 10-2018-0026829 A 3/2018

OTHER PUBLICATIONS

Machine Translation of JP-H07275033-A (Year: 1995).*

* cited by examiner

*Primary Examiner* — David P Angwin
*Assistant Examiner* — Bradley S Oliver
(74) *Attorney, Agent, or Firm* — Bridgeway IP Law Group, PLLC; Sang Ho Lee; Hyun Woo Shin

(57) ABSTRACT

A container according to an embodiment of the present disclosure includes a container part formed by a packaging sheet wound to have an accommodation space, which is configured to accommodate contents, at an inner side thereof; and a holder part having at least one region inserted into the container part to support the container part.

15 Claims, 19 Drawing Sheets

CONTENT CONTAINER

TECHNICAL FIELD

The present disclosure relates to a container.

BACKGROUND ART

Generally, stick type containers of lipsticks, lip balms, eyebrow pencils, eyeliners and the like are used to directly apply cosmetic compositions to a user's lips, skin, and the like. Since the size/volume of a cosmetic composition decreases with use of such a stick type container, in order to allow the user to continuously use the cosmetic composition, a container having a structure that can lift or lower a cosmetic composition is used as the stick type container, or the stick type container is manufactured in the form of a pencil in which a cosmetic composition is surrounded by a wood material or the like.

However, the conventional container that can lift or lower a cosmetic composition has disadvantages in that, since the container is made of an inner container accommodating a cosmetic composition and an outer container surrounding the inner container, and a rotating member or a sliding member that can lift or lower the cosmetic composition by rotating or sliding needs to be provided at the inner container and an inner side of the outer container, the configuration of the container is complex due to requiring a plurality of components, and the manufacturing cost is high. Also, since the container that can lift or lower a cosmetic composition is mostly made of a plastic material, a metal material, or the like, it is difficult to separate the components when disposing of the container, which may cause environmental pollution.

DISCLOSURE

Technical Problem

The present disclosure is directed to providing a container for addressing the above problems.

The technical objectives of the present disclosure are not limited to the above-mentioned objective, and other unmentioned objectives may become apparent to those of ordinary skill in the art from the following description.

Technical Solution

An embodiment of the present disclosure provides a container. The container includes a container part formed by a packaging sheet wound to have an accommodation space, which is configured to accommodate contents, at an inner side thereof; and a holder part having at least one region inserted into the container part to support the container part.

An entire region of the holder part may be inserted into the container part.

The holder part may include a base and an insertion part formed to protrude from the base and inserted into the container part.

At least one portion of the holder part may be made of an expandable/contractable material, and the at least one portion may expand after the at least one portion is inserted into the container part in a state in which a volume of the at least one portion is reduced.

The at least one portion of the holder part may be soft or hard.

The insertion part may be soft or hard, and the base may be hard.

The container may further include a tear-off thread provided in a longitudinal direction of the container part to cut the packaging sheet in the longitudinal direction.

The tear-off thread may have one side disposed at one surface of the packaging sheet and the other side disposed at the other surface of the packaging sheet about a bent region and may have both end portions exposed to the outside while located in the same direction.

One end portion of the tear-off thread may be exposed to an outer side of the packaging sheet, the other end portion of the tear-off thread may be inserted into the container part, and the tear-off thread may be fitted and fixed by the holder part and the packaging sheet.

A plurality of breakage parts spaced from each other may be formed at the tear-off thread to facilitate cutting of the tear-off thread.

The container part may further include a first perforated line formed in the packaging sheet in a width direction thereof and a second perforated line formed in the packaging sheet in a longitudinal direction thereof.

A length of the container part may range from 4 to 13 cm, an inner diameter of the container part may range from 4 to 22 mm, and a length of the holder part inserted into the container part may range from 1 to 5 cm.

The length of the container part may range from 6 to 9 cm, and the length of the holder part inserted into the container part may range from ⅕ to ½ of the length of the container part.

An end portion of the holder part inserted into the container part may have a radius of curvature ranging from 1 to 3 R along a circumference.

A material of the packaging sheet may be paper.

The packaging sheet and the holder part may have the same material.

The container may further include an inner stopper having at least one region inserted into the container part and a stopper detachably coupled to the container part.

The contents may be a solid composition obtained by filling the accommodation space with the contents in a fluid state and hardening the contents.

The contents may have a hardness ranging from 20 to 150 dyne/cm$^2$.

The contents may have a shrinkage rate of less than 20% when hardened.

Advantageous Effects

According to the present disclosure, since it is possible to expose a necessary amount of contents and provide the contents to a user by a method of sequentially tearing off a packaging sheet surrounding the contents without an additional tool, portability and convenience of use are high.

Also, according to the present disclosure, contents can be sealed and a container part can be supported by a holder part. In particular, the container part can be easily gripped through the holder part, and the holder part can prevent detachment of a tear-off thread by fixing the tear-off thread.

In addition, in the related art, while it is substantially impossible to use even contents filled to a lower end of a container part and the contents are inevitably wasted due to difficulty of gripping/supporting the container part, according to the present disclosure, since at least one portion of the holder part is inserted into the lower end of the container part so that the contents are not filled at the lower end of the container part, wasting of the contents can be prevented.

DESCRIPTION OF DRAWINGS

A brief description of each drawing will be provided for better understanding of the drawings referenced in the detailed description of the present disclosure.

MODES OF THE INVENTION

Figure 1:
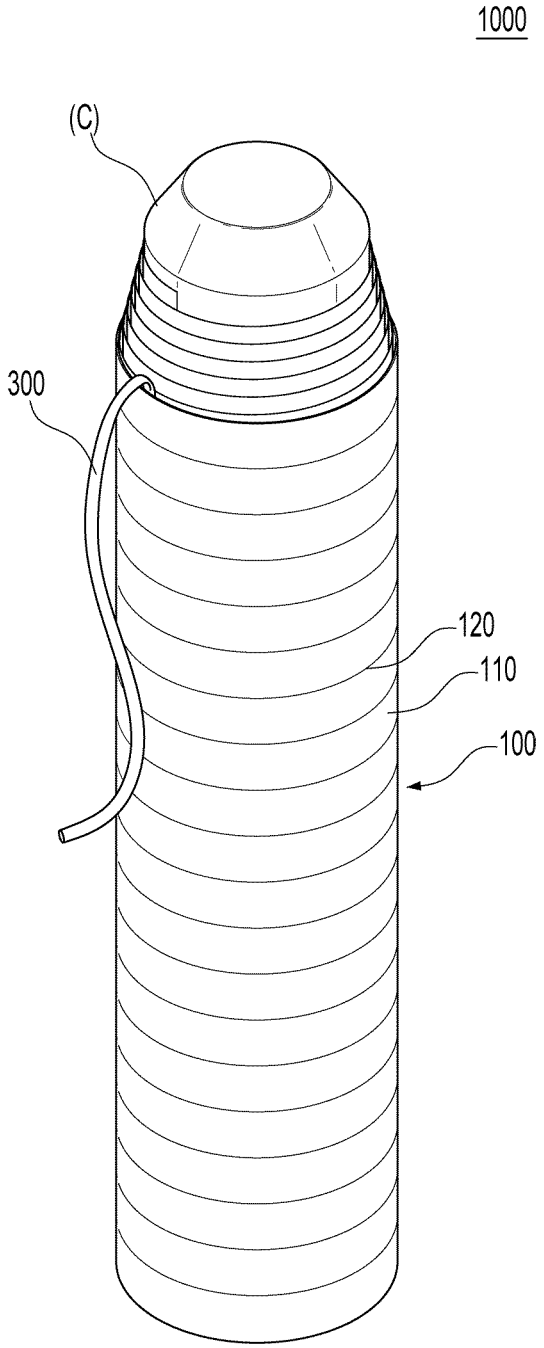
FIG. 1 is a perspective view of a container according to an embodiment of the present disclosure.

Hereinafter, exemplary embodiments according to the present disclosure will be described in detail with reference to the accompanying drawings. Also, methods of configuring and using the embodiments of the present disclosure will be described in detail with reference to the accompanying drawings. The same reference numeral or symbol throughout the drawings indicates a component or element that performs substantially the same function. For convenience of description, directions such as vertical and horizontal mentioned herein are based on the drawings, and the scope of rights of the present disclosure is not necessarily limited by the corresponding directions.

Terms including ordinals such as "first" and "second" may be used to describe various elements, but the elements are not limited by the terms. The terms are only used for the purpose of distinguishing one element from another element. For example, without departing from the scope of rights of the present disclosure, a first element may be referred to as a second element, and likewise, a second element may also be referred to as a first element. The term "and/or" includes a combination of a plurality of related items or any one item among the plurality of related items.

Terms used herein are used to describe embodiments and are not intended to limit and/or restrict the present disclosure. A singular expression includes a plural expression unless the context clearly indicates otherwise. In the specification, terms such as "include" or "have" should be understood as specifying that features, numbers, steps, operations, elements, components, or combinations thereof are present and not as precluding the possibility of the presence or addition of one or more other features, numbers, steps, operations, elements, components, or combinations thereof in advance.

Throughout the specification, when a certain part is described as being connected to another part, this not only includes a case in which the certain part is directly connected to the other part but also includes a case in which the certain part is indirectly connected to the other part with another device disposed therebetween. Also, when a certain part is described as including a certain element, this signifies that the certain part may further include other elements rather than excluding other elements unless particularly described otherwise.

Figure 2:
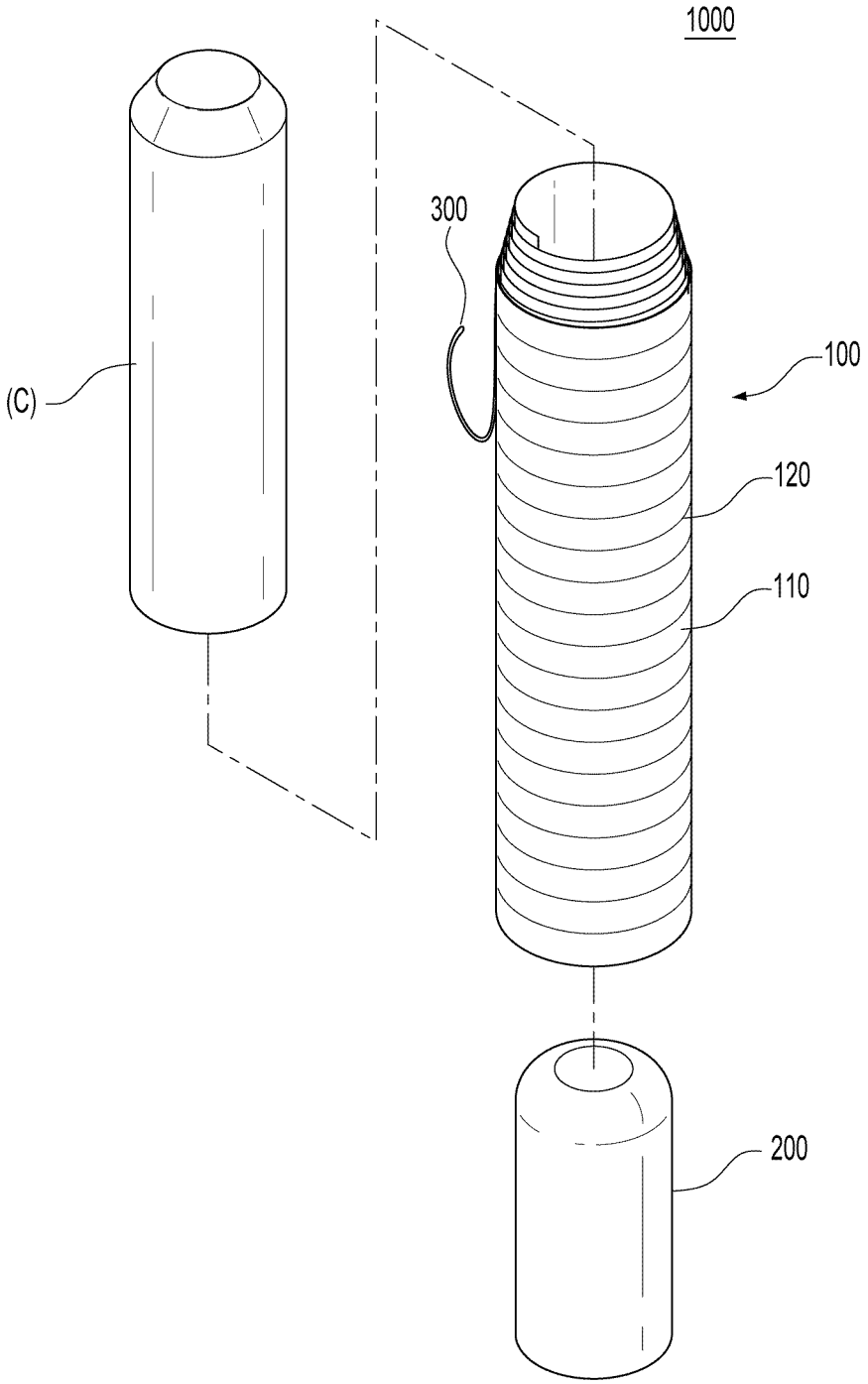
FIG. 2 is an exploded perspective view of the container according to an embodiment of the present disclosure.
Figure 3:
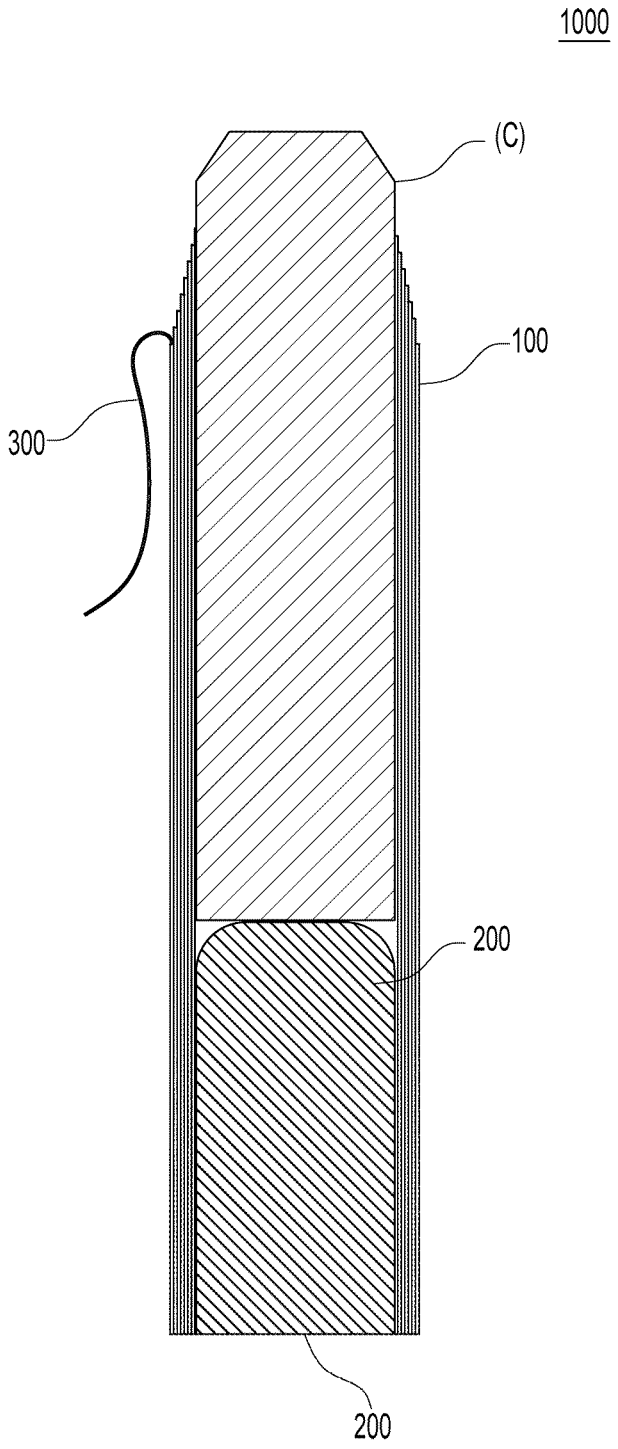
FIG. 3 is a cross-sectional view of the container according to an embodiment of the present disclosure.

FIG. 1 is a perspective view of a container according to an embodiment of the present disclosure, FIG. 2 is an exploded perspective view of the container according to an embodiment of the present disclosure, and FIG. 3 is a cross-sectional view of the container according to an embodiment of the present disclosure.

Referring to FIGS. 1 to 3, a container 1000 may include a container part 100, a holder part 200, and a tear-off thread 300.

The container part 100 may, while surrounding contents C, not only protect the contents C from external contamination or the like but also support the contents C. Here, the contents C may be a cosmetic composition in a solid or semi-solid phase. Examples of the cosmetic composition may include a lotion, a milk lotion, a moisturizing lotion, a nourishing lotion, a skin lotion, a skin softener, a skin toner, an astringent, a massage cream, a nourishing cream, a moisturizing cream, a skin lightening essence, a tone up cream, a liquid sunscreen, sunblock, sun milk, a blemish balm (BB) cream, a base, a foundation, a color correcting (CC) cream, concealer, blusher, contour powder, an eye cream, a primer, and the like having a solid or semi-solid formulation. Also, according to embodiments, the cosmetic composition may be a stick type cosmetic composition. Examples of the cosmetic composition may include a multi-balm, a lip balm, a lipstick, a sun stick, a foundation, an eye shadow, blusher, a cleanser, an eye cream, an eyebrow pencil, an eyeliner, hair wax, hair dye, a foot balm, and the like. However, such cosmetic compositions are illustrative, and other formulations or types of cosmetic compositions may be applied according to embodiments. Also, instead of a cosmetic composition, health supplementary contents, medical contents, or the like may be applied as the contents C, and all of these may be referred to as "contents C."

The container part 100 may be formed by a packaging sheet 110 wound to have an accommodation space, which is configured to accommodate the contents C, at an inner side thereof. The packaging sheet 110 may be wound in layers. The packaging sheet 110 may be wound to form the accommodation space at the inner side thereof. For example, at least one portion of the contents C may be surrounded by the packaging sheet 110 and shielded from the outside, and at least one other portion (in particular, an end portion of a cosmetic composition) may be exposed to the outside and provided to the user. However, this is only illustrative, and the contents C may be entirely surrounded by the packaging sheet 110 and shielded from the outside. In this case, one portion of the contents C may be exposed to the outside and provided to the user by tearing off at least one portion of the packaging sheet 110 and separating it from the container 1000.

In an embodiment, after the packaging sheet 110 is wound to form the accommodation space, the contents C in a solid or semi-solid phase may be formed by filling the accommodation space with the contents C in a fluid state and hardening the contents C.

In an embodiment, the contents C may be formed only in at least one region of the accommodation of the container part 100. That is, the contents C are not formed throughout the accommodation space, and accordingly, an empty space may be formed at an upper end and/or a lower end of the container part 100. For example, at least one portion of the holder part 200 may be inserted into the space at the lower end of the container part 100. Also, an inner stopper 500 (see FIGS. 15 and 16) may be coupled to the space at the upper end of the container part 100. Also, such a space may also be a space formed due to a sealing member (not illustrated) for preventing leakage of the contents C when the accommodation space is filled with the contents C. However, the present disclosure is not limited thereto.

In an embodiment, at least one portion of the holder part 200 may be inserted into the lower end of the container part 100, and accordingly, the contents C may not be located at the lower end of the container part 100. Conventionally, the entire space in a container is filled with contents, and in this case, a cosmetic material located at a lower end of the container is often left unused due to being inconvenient for a user to use. However, in an embodiment of the present disclosure, wasting of the contents C can be prevented by at least one portion of the holder part 200 being inserted into the space where the contents left unused are conventionally located (that is, the lower end of the container part 100).

In an embodiment, at least one portion of the packaging sheet 110 may be made of paper. That is, the packaging sheet 110 may include a paper sheet. That is, it is eco-friendly because the packaging sheet 110 surrounding the contents is made of paper. Examples of the material of the packaging sheet may include coated paper, machine-finished coated (MFC) paper, noncoated paper, and the like. Here, the coated paper is paper coated through a coater or the like and may include gloss coated paper, matte coated paper, coated paper, cast coated paper, embossed paper, and the like, the MFC paper is paper on which coating of around 10 g is performed on both surfaces per 1 $m^2$ by a size press during a process of making vellum paper (bond paper) or middle-grade paper, and the noncoated paper is paper on which coating is not performed and may include vellum paper (bond paper), middle-grade paper, and the like. However, the present disclosure is not limited thereto. In addition, a coating material may be applied on at least one surface of the packaging sheet 110, and a coating layer may be formed. Here, coating may include gloss lamination, matte lamination, ultraviolet (UV) coating, clear coating, and the like. However, the present disclosure is not limited thereto.

In an embodiment, the packaging sheet 110 may further include at least one layer. The layer may be for improving the strength, durability, waterproofness, or the like of the packaging sheet 110. To this end, the layer may be formed by various functional materials being applied on the packaging sheet 110. For example, the layer may be a waterproof layer. For example, the layer may be a protective layer for preventing stains. Also, for example, the layer may be a hardness increasing layer. Such a layer may be formed on the entire region or one region of the packaging sheet 110. For example, on the packaging sheet 110 in a wound state, the layer may be formed on at least the outermost side of the packaging sheet 110. However, the present disclosure is not limited thereto.

The container part 100 may include a perforated line 120. The perforated line 120 may be formed on a surface of the packaging sheet 110 to facilitate cutting of the packaging sheet 110. At least one portion of the packaging sheet 110 may be torn off along the perforated line 120 to expose the contents C surrounded by the packaging sheet 110 to the outside. For example, the perforated line 120 may include a series of through-holes and/or grooves formed in a surface of the packaging sheet 110. That is, at least one portion of the packaging sheet 110 may be torn off along the series of through-holes and/or grooves.

In an embodiment, a tear-off direction may be determined according to a direction in which the perforated line 120 is formed. For example, the perforated line 120 may be formed in a width direction (that is, horizontal direction) of the packaging sheet 110 or a winding direction of the packaging sheet 110. That is, at least one portion of the packaging sheet 110 may be torn off in the opposite direction of the winding direction.

In an embodiment, a plurality of perforated lines 120 may be formed on the packaging sheet 110. Intervals between the perforated lines 120 may be tear-off units of the packaging sheet 110. For example, the intervals between the perforated lines 120 may range from 1 to 5 mm. However, the present disclosure is not limited thereto.

The holder part 200 is provided at one end portion of the container 1000 to support the container part 100 and may be inserted into the container part 100.

The holder part 200 may be inserted at a predetermined length into the container part 100 to block the empty space of the container part 100 and prevent the contents C from being pushed backward. Also, the holder part 200 may support the container part 100 from an inner side thereof, and in particular, since the holder part 200 that is relatively harder than the contents C is provided at the inner side of the container part 100, the container 1000 may be gripped through the corresponding region.

In particular, when filling the container part 100 with the contents C, a predetermined region is not filled with the contents C to allow the holder part 200 to be inserted. That is, an empty space for insertion of the holder part 200 may be formed at an end portion of the container part 100. Here, even when the size of the empty space and the size of the holder part 200 do not exactly match, an excess portion, that is, a portion of the end portion of the container part 100 that comes in contact with the holder part 200, may be removed after the holder part 200 is inserted to come in contact with the contents C. In this way, the holder part 200 and the contents C may come in close contact, and the end portion of the container part 100 may correspond to the holder part 200.

In an embodiment, at least one protrusion and/or at least one groove (not illustrated) may be formed on and/or in an outer surface of the holder part to strengthen coupling to the packaging sheet 110.

According to embodiments, an adhesive or the like may be applied between at least one portion of the holder part 200 and the container part 100 to further strengthen coupling between the holder part 200 and the container part 100.

In an embodiment, various materials may be applied to the holder part 200, and in this way, characteristics of the holder part 200 may be changed in various ways. For example, at least one portion of the holder part 200 may be made of a material such as pulp, wood, cork, paper, or plastic. Also, for example, at least one portion of the holder part 200 may be made of the same material as the packaging sheet 110, e.g., paper. However, the present disclosure is not limited thereto.

In an embodiment, at least one portion of the holder part 200 may be soft or hard. Here, being soft may be a property of being shape-deformable such as being bendable or compressible due to an external force. In addition, when at least one portion of the holder part 200 is soft, the at least one portion of the holder part 200 may have elasticity that allows the at least one portion of the holder part 200 to be restored to its original shape even when the shape is deformed due to an external force or the like. On the other hand, being hard may be a property of resisting an external force such that the shape is not deformable, or a degree of deformation is insignificant. For example, the holder part 200 may be soft or hard. For example, one portion of the holder part 200 may be soft, and another portion of the holder part 200 may be hard. However, the present disclosure is not limited thereto.

In an embodiment, at least one portion of the holder part 200 may be made of an elastic material or an expandable/contractable material (for example, pulp, cork, paper, and the like). That is, at least one portion of the holder part 200 may be stretched, bent, and/or compressed (or pressed), and when the shape is deformed in this way, an elastic force (or restoration force) for restoring it to its original shape may be generated. For example, at least one portion of the holder part 200 may be inserted into the container part 100 in a state in which the volume of the at least one portion is reduced due to an external force or the like, and then the reduced volume may expand to its original state. In this way, the at least one portion of the holder part 200 that is inserted into the container part 100 may more tightly come in contact with the container part 100.

In an embodiment, an end portion of the holder part 200 (that is, the holder part) inserted into the container part 100 may have a predetermined radius of curvature (mm) along the circumference to facilitate insertion into the container part 100. For example, the end portion of the holder part 200 may have a radius of curvature ranging from 0.1 to 15 R. For example, the end portion of the holder part 200 may have a radius of curvature ranging from 0.1 to 10 R. For example, the end portion of the holder part 200 may have a radius of curvature ranging from 0.1 to 7 R. For example, the end portion of the holder part 200 may have a radius of curvature ranging from 1 to 3 R. For example, the end portion of the holder part 200 may have a radius of curvature ranging from 1.8 to 2.2 R. However, the present disclosure is not limited thereto.

In an embodiment, a predetermined coating material may be applied on lower ends of the container part 100 and the holder part 200. The coating material may be applied to cover both the lower end of the container part 100 and the lower end of the holder part 200. In this way, the lower end of the container part 100 and the lower end of the holder part 200 may be prevented from being exposed to the outside to protect the container part 100 and the holder part 200 from contamination or damage.

The tear-off thread 300 may be provided on one region of the packaging sheet 110 to allow at least one region of the packaging sheet 110 to be torn off. Specifically, in a state in which the tear-off thread 300 is provided in a longitudinal direction of the container part 100, at least one portion of the tear-off thread 300 is exposed to the outside, and at least one other portion of the tear-off thread 300 is surrounded by the packaging sheet 110, the packaging sheet 110 surrounding the tear-off thread 300 may be cut in the longitudinal direction by the tear-off thread 300 through an operation of pulling or lowering the exposed tear-off thread 300. In particular, when the packaging sheet 110 is made of paper, the packaging sheet 110 can be more easily torn off by the tear-off thread 300. After the packaging sheet 110 is torn off by the tear-off thread 300 in this way, secondary tearing-off may be performed on the torn-off packaging sheet 110 along the perforated line 120.

For example, the tear-off thread 300 may be located to come in contact with an inner surface of a layer of the packaging sheet 110 that is located at the outermost side among the layers of the packaging sheet 110 that are wound and overlap each other. However, the present disclosure is not limited thereto, and for example, the tear-off thread 300 may be provided at an inner surface of the second or third layer of the packaging sheet 110 from the outermost layer of the packaging sheet 110.

In an embodiment, the tear-off thread 300 may be applied together when the packaging sheet 110 is wound and may be located inward from the packaging sheet 110 while being surrounded by the packaging sheet 110. At least one region of the tear-off thread 300 may be adhered to the packaging sheet 110 by an adhesive or the like to facilitate winding and fixing of the tear-off thread 300. However, the present disclosure is not limited thereto.

According to embodiments, various materials such as fiber and paper may be applied to the tear-off thread 300.

In an embodiment, a plurality of breakage parts (not illustrated) spaced from each other may be formed at the tear-off thread 300. A breakage part is for facilitating breakage of the tear-off thread 300 and may be formed so that a breaking strength (or tensile strength) of at least one region of the tear-off thread 300 is different from a breaking strength of at least one other region of the tear-off thread 300. The breakage part may be formed as a plurality of breakage parts, and the plurality of breakage parts may be formed to be spaced from each other. That is, the user can separate one region of the tear-off thread 300 from another region thereof at the breakage part and thus can remove an unnecessary tear-off thread 300 from the container 1000.

For example, the breakage part may be formed by a groove and/or a through-hole formed in a surface of the tear-off thread 300. Also, for example, mechanical, thermal, or chemical deformation may be applied to at least one region of the tear-off thread 300 to make the breaking strength of the corresponding region different from that of another region. However, the present disclosure is not limited thereto.

According to embodiments, intervals between the breakage parts may be the same as or different from the intervals between the perforated lines 120. In the latter case, the intervals between the breakage parts may be larger than the intervals between the perforated lines 120. For example, the interval between the breakage parts may be N times the interval between the perforated lines 120, where N is an integer greater than 1.

In an embodiment, primary tearing-off and secondary tearing-off may be performed on the packaging sheet 110 for exposure of the contents C. Specifically, at least one portion of the packaging sheet 110 may be primarily torn off in the longitudinal direction of the container 1000, and the torn-off packaging sheet 110 may be secondarily torn off along the perforated line 120. For the primary tearing-off, the tear-off thread 300 and/or perforations may be provided in the packaging sheet 110 in the longitudinal direction thereof. However, the present disclosure is not limited thereto.

In an embodiment, the size (width and length) of the packaging sheet 110 may be set in various ways. For example, the width of the packaging sheet 110 may be determined in consideration of the purpose, properties, and cross-sectional area of the contents C, the number of times the packaging sheet 110 is wound, the thickness of the packaging sheet 110, the strength of the packaging sheet 110, and the like. For example, the width of the packaging sheet 110 may be determined so that the container 1000 has a thickness that can provide a satisfactory grip feeling while maintaining an appropriate strength. Also, for example, the length of the packaging sheet 110 may be determined according to the length of the container 1000, the amount (or length) of the contents C, the size of the holder part 200, and the like. However, the present disclosure is not limited thereto.

For example, the packaging sheet 110 may have a size having a horizontal length ranging from 4 to 13 cm and a vertical length ranging from 15 to 70 cm. For example, the packaging sheet 110 may have a thickness ranging from 0.1 mm to 0.5 mm. For example, the packaging sheet 110 may have a thickness ranging from 0.1 mm to 0.5 mm and a basis weight ranging from 50 to 300 g/m$^2$. Also, for example, the packaging sheet 110 may have a size that is wound 6 to 8 times. However, the present disclosure is not limited thereto.

In an embodiment, thicknesses of one region and another region of the packaging sheet 110 may be different from each other. For example, in the packaging sheet 110 in a wound state, a thickness of a layer of the packaging sheet 110 that corresponds to at least the outermost side of the packaging sheet 110 may be smaller than thicknesses of other layers of the packaging sheet 110. In this way, the packaging sheet 110 may be easily torn off using the perforated line 120, the tear-off thread 300, and the like.

In an embodiment, the length of the container part 100 may range from 4 to 13 cm. In addition, an inner diameter of the container part 100 may range from 4 to 22 mm, and a length of the holder part 200 inserted into the container part 100 may range from 1 to 5 cm. However, the present disclosure is not limited thereto.

In an embodiment, the length of the container part 100 may range from 6 to 9 cm. In addition, the length of the holder part 200 inserted into the container part 100 may range from ⅕ to ½ of the length of the container part 100. However, the present disclosure is not limited thereto.

According to embodiments, the container 1000 may further include contents C. Here, the accommodation space of the container 1000 may be filled with the contents C in a fluid state, and the contents C may be hardened. When the contents C are a cosmetic composition, the container 1000 may also be referred to as a cosmetic product.

In an embodiment, the contents C may be a solid cosmetic composition. Here, for example, a shrinkage rate of a cosmetic composition in a fluid state when the cosmetic composition is hardened may be less than 20%. For example, the shrinkage rate may range from 0.1 to 20%, specifically, from 0.1 to 15%, and more specifically, from 5 to 15%. That is, unlike the related art in which contents C in a liquid phase should shrink while hardened and be easily separated from a container to facilitate elevating and improve product quality and stability, in an embodiment of the present disclosure, the shrinkage rate of the contents C may be formed to be low to prevent separation from the container part (made of paper, in particular).

In an additional/alternative embodiment, the cosmetic composition may have a hardness ranging from 20 to 150 dyne/cm$^2$ (measurement standard: FUDOH rheometer, 1 mmΦ, 200 g, 30 cm/min, 10 mm depth). Additionally/alternatively, the contents C may have a melting point ranging from 45 to 95° C.

The container 1000 illustrated in FIGS. 1 to 3 is only illustrative, and various other configurations may be applied according to embodiments to which the present disclosure is applied.

Figure 4:
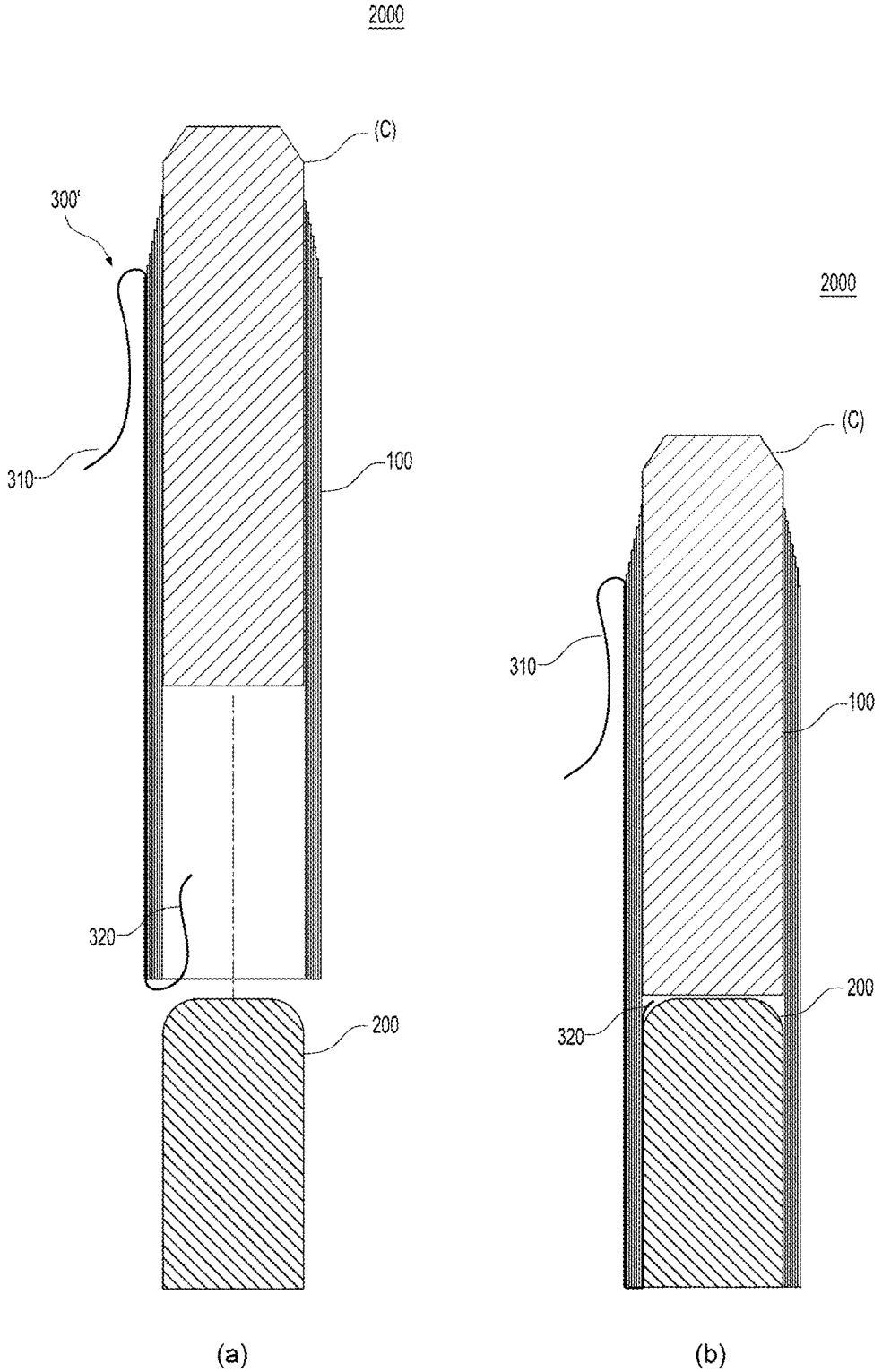
FIG. 4 is a cross-sectional view of a container according to an embodiment of the present disclosure.

FIG. 4 is a cross-sectional view of a container according to an embodiment of the present disclosure.

A container 2000 of FIG. 4 will be described below, and description overlapping with the above description of the container 1000 of FIGS. 1 to 3 will be omitted.

Referring to FIG. 4A, one end portion 310 of a tear-off thread 300' may be exposed to an outer side of the packaging sheet 110, and the other end portion 320 of the tear-off thread 300' may be inserted into the container part 100. In a state in which the other end portion 320 of the tear-off thread 300' is inserted into the container part 100, as the holder part 200 is coupled to the container part 100, the other end portion 320 of the tear-off thread 300' may be fitted and fixed between the holder part 200 and the container part 100 (see FIG. 4B).

Specifically, one region of the other end portion 320 of the tear-off thread 300' may be fitted and fixed between the lower end of the container part 100 and the holder part 200, and/or another region of the other end portion 320 of the tear-off thread 300' may be fitted and fixed between an inner surface of the container part 100 and the holder part 200.

In this way, since the tear-off thread 300' is more firmly fixed, a problem in which the tear-off thread 300' is removed or detached from the container part 100 can be prevented even when a tear-off operation is performed by pulling or lowering the tear-off thread 300'.

The container 2000 illustrated in FIG. 4 is only illustrative, and various other configurations may be applied according to embodiments to which the present disclosure is applied.

Figure 5:
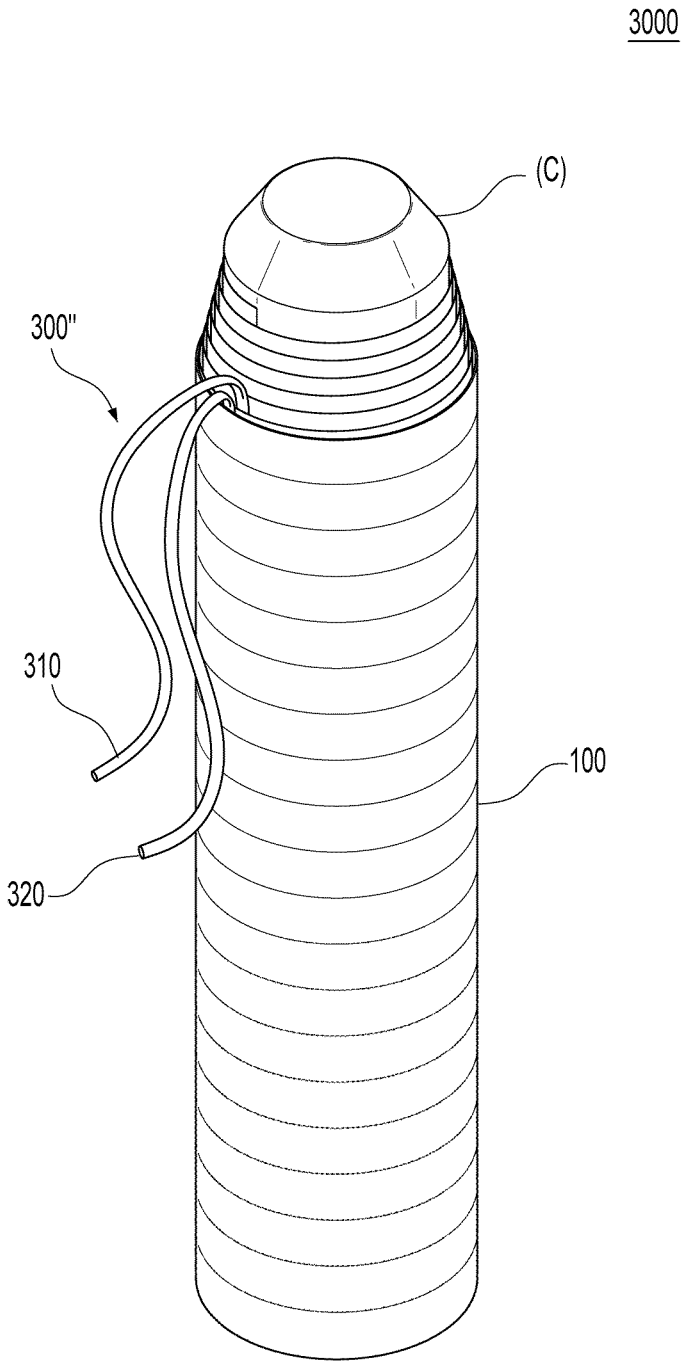
FIG. 5 is a perspective view of a container according to an embodiment of the present disclosure.

FIG. 5 is a perspective view of a container according to an embodiment of the present disclosure.

A container 3000 of FIG. 5 will be described below, and description overlapping with the above description of the containers 1000 and 2000 of FIGS. 1 to 4 will be omitted.

Referring to FIG. 5, in the container 3000, both end portions 310 and 320 of a tear-off thread 300" may be located in the same direction. Specifically, both one end portion 310 and the other end portion 320 of the tear-off thread 300" may be exposed to the outside while located at an upper side of the container part 100. Here, a bent region may be formed between the one end portion 310 and the other end portion 320 in the tear-off thread 300".

In an embodiment, the bent region may come in contact with the lower end of the packaging sheet 110, and about the bent region, one side of the tear-off thread 300" and the other side of the tear-off thread 300" may be located in different regions (for example, an outer surface, an inner surface, and the like) of the packaging sheet 110.

That is, since the bent region has a hook shape and may allow the tear-off thread 300" to be caught at the packaging sheet 110, and a frictional area and a frictional force between the packaging sheet 110 and the tear-off thread 300" increase, the tear-off thread 300" can be prevented from being detached from the container part 100.

Unlike the above, according to embodiments, the bent region may be inserted into the container part 100. That is, in a state in which the bent region of the tear-off thread 300" is inserted into the container part 100, as the holder part 200 is coupled to the container part 100, the tear-off thread 300"

may be fitted and fixed between the holder part 200 and the container part 100. Such fitting and fixing may be performed between the lower end of the container part 100 and the holder part 200 and/or between the inner surface of the container part 100 and the holder part 200.

The container 3000 illustrated in FIG. 5 is only illustrative, and various other configurations may be applied according to embodiments to which the present disclosure is applied.

Figure 6:
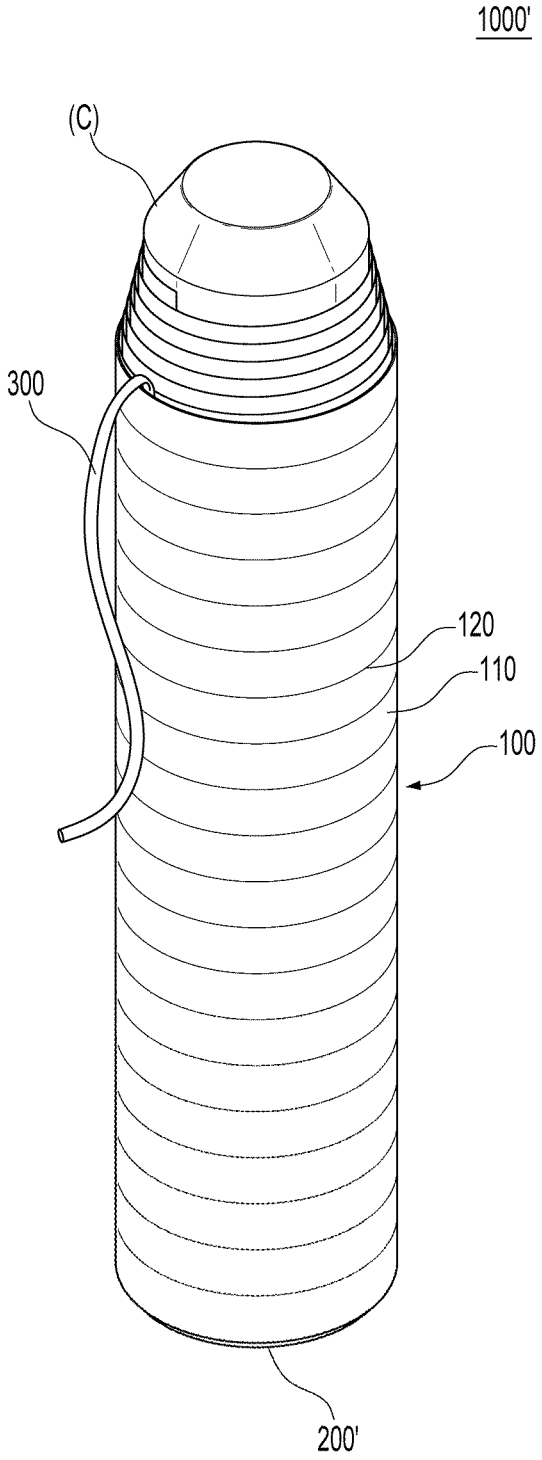
FIG. 6 is a perspective view of a container according to an embodiment of the present disclosure.
Figure 7:
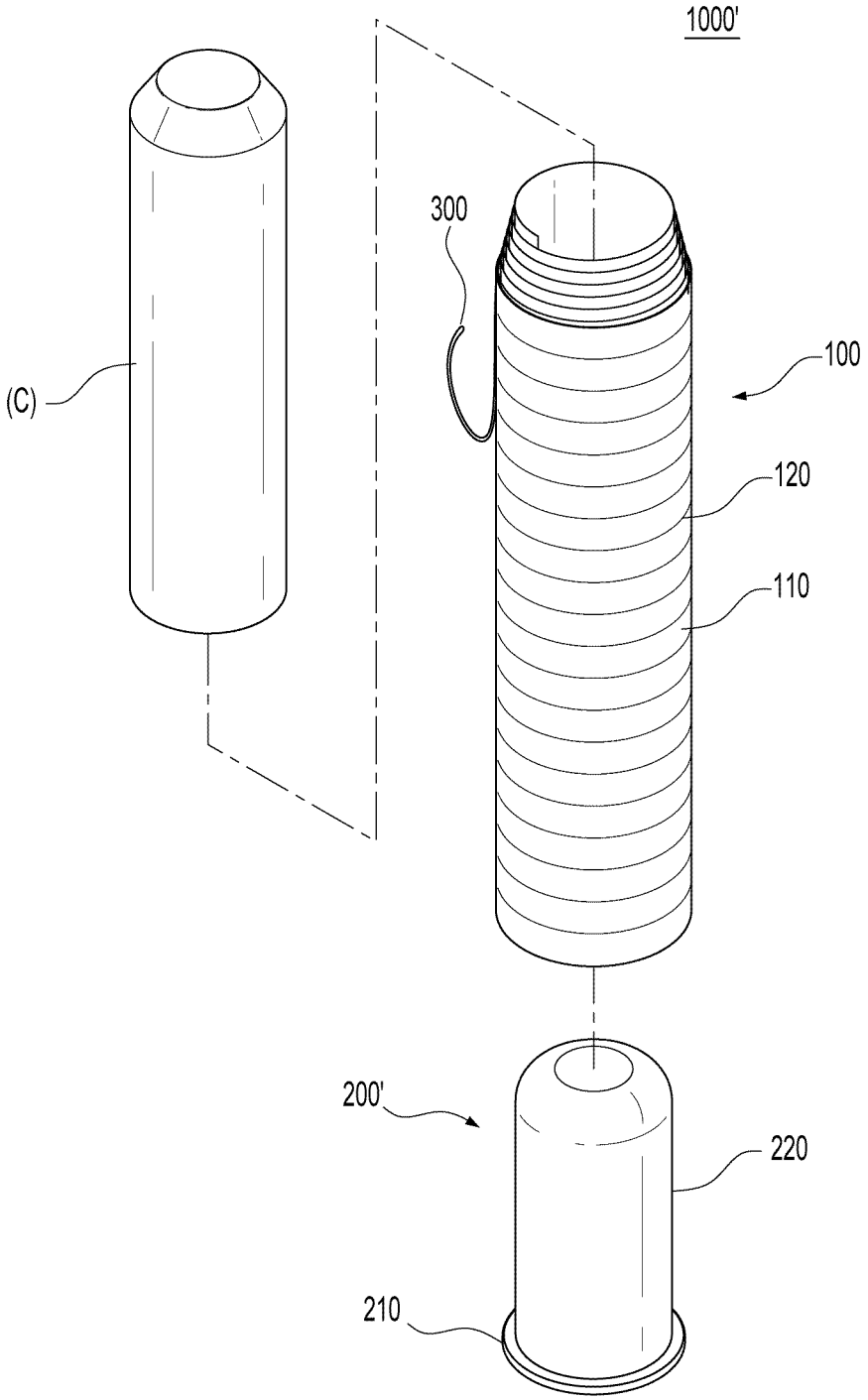
FIG. 7 is an exploded perspective view of the container according to an embodiment of the present disclosure.
Figure 8:
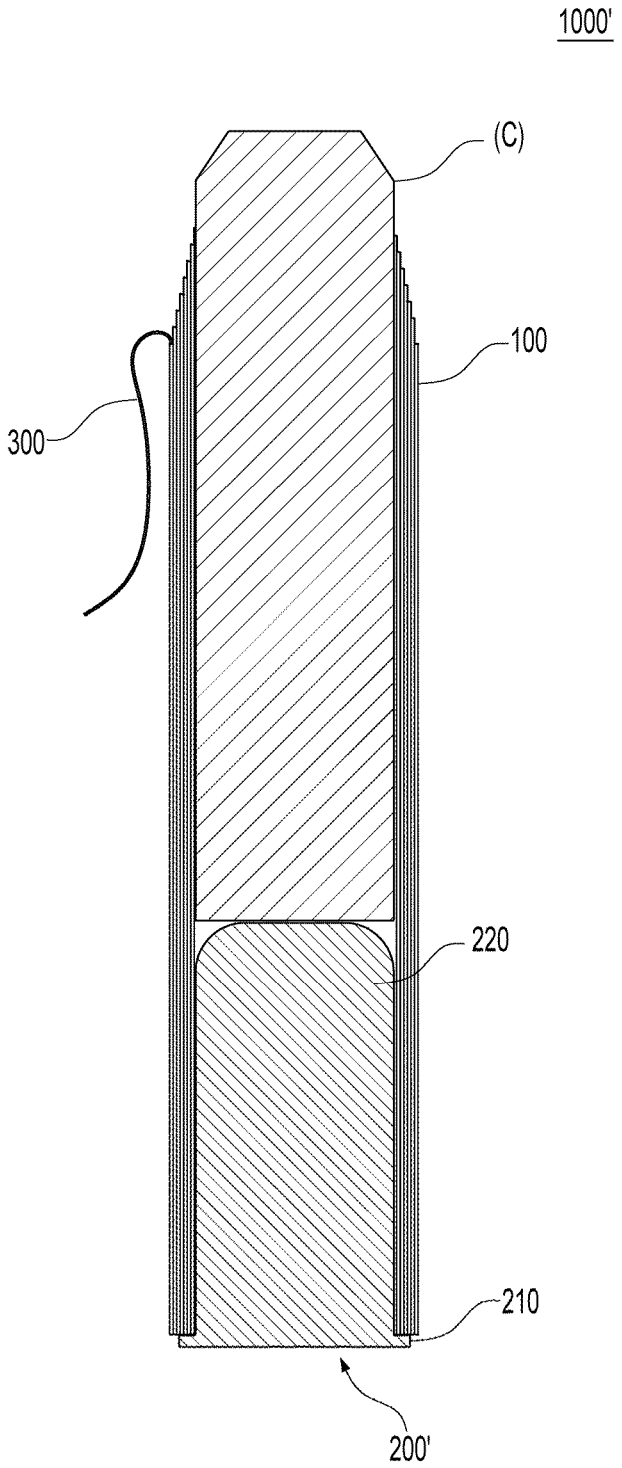
FIG. 8 is a cross-sectional view of the container according to an embodiment of the present disclosure.

FIG. 6 is a perspective view of a container according to an embodiment of the present disclosure, FIG. 7 is an exploded perspective view of the container according to an embodiment of the present disclosure, and FIG. 8 is a cross-sectional view of the container according to an embodiment of the present disclosure.

A container 1000' of FIGS. 6 to 8 will be described below, and description overlapping with the above description of the container 1000 of FIGS. 1 to 3 will be omitted.

Referring to FIGS. 6 to 8, a holder part 200' of the container 1000' may include a base 210 and an insertion part 220 formed to protrude from the base 210 and inserted into the container part 100. The base 210 may be formed to cover the lower end of the container part 100 to block the empty space of the container part 100 and prevent the contents C from being pushed backward. Also, the base 210 may support the lower end of the container part 100. Here, the base 210 may or may not come in contact with the lower end of the container part 100. Also, the insertion part 220 may be inserted at a predetermined length into the container part 100 to support the container part 100 from an inner side thereof. In particular, since the insertion part 220 that is relatively harder than the contents C is provided at the inner side of the container part 100, the container 1000' may be gripped through the corresponding region.

In an embodiment, at least one protrusion and/or at least one groove (not illustrated) may be formed on and/or in an outer surface of the insertion part 220 to strengthen coupling to the packaging sheet 110.

In an embodiment, one portion of the holder part 200' (for example, the insertion part 220 of the holder part 200') may be soft, and another portion of the holder part 200' (for example, the base 210 of the holder part 200') may be hard. However, the present disclosure is not limited thereto.

In an embodiment, at least one portion of the holder part 200' (for example, the insertion part 220) may be inserted into the container part 100 in a state in which the volume of the at least one portion is reduced due to an external force or the like, and then the reduced volume may expand to its original state.

According to embodiments, the holder part 200' may be formed so that at least one portion thereof surrounds an end portion of the container part 100 instead of being inserted into the container part 100.

Figure 9:
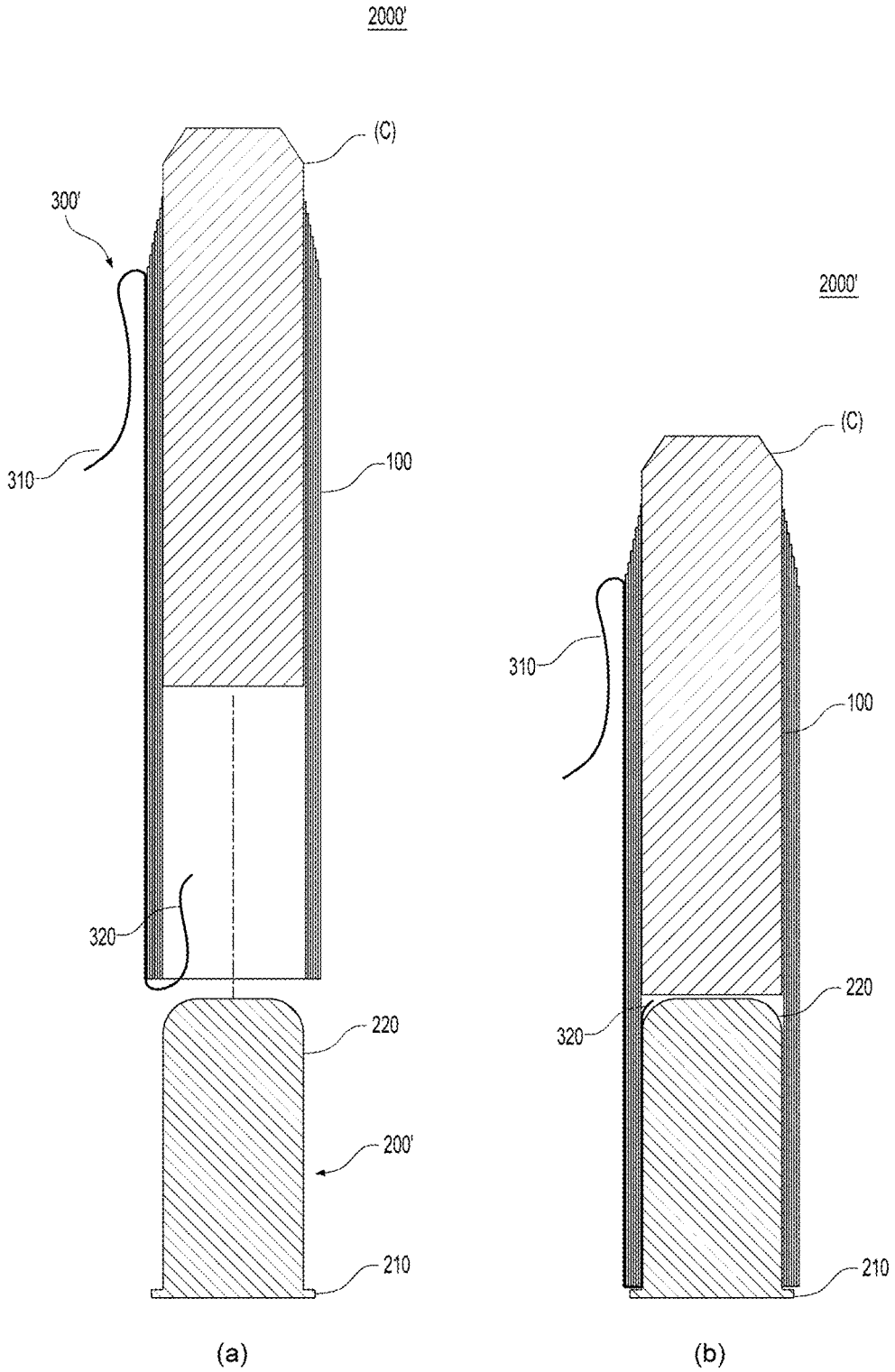
FIG. 9 is a cross-sectional view of a container according to an embodiment of the present disclosure.

The container 1000' illustrated in FIGS. 6 to 8 is only illustrative, and various other configurations may be applied according to embodiments to which the present disclosure is applied. FIG. 9 is a cross-sectional view of a container according to an embodiment of the present disclosure.

A container 2000' of FIG. 9 will be described below, and description overlapping with the above description of the containers 1000, 1000', and 2000 of FIGS. 1 to 8 will be omitted.

Referring to FIG. 9, one region of the other end portion 320 of the tear-off thread 300' may be fitted and fixed between the lower end of the container part 100 and the base 210 of the holder part 200', and/or another region of the other end portion 320 of the tear-off thread 300' may be fitted and fixed between the inner surface of the container part 100 and the insertion part 220 of the holder part 200'.

The container 2000' illustrated in FIG. 9 is only illustrative, and various other configurations may be applied according to embodiments to which the present disclosure is applied.

Figure 10:
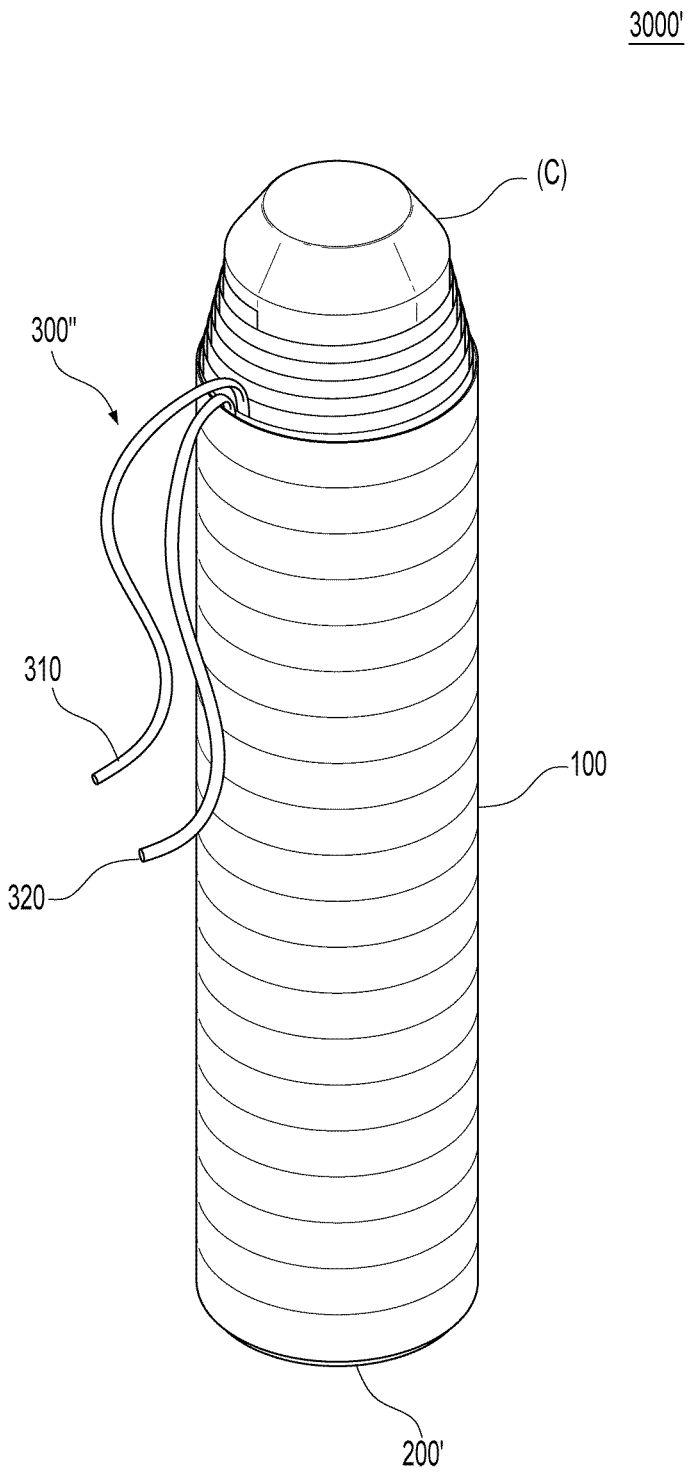
FIG. 10 is a perspective view of a container according to an embodiment of the present disclosure.

FIG. 10 is a perspective view of a container according to an embodiment of the present disclosure.

A container 3000' of FIG. 10 will be described below, and description overlapping with the above description of the containers 1000, 1000', 2000, and 2000' of FIGS. 1 to 9 will be omitted.

Referring to FIG. 10, a bent region may be formed between one end portion 310 and the other end portion 320 in the tear-off thread 300". The bent region may be inserted into the container part 100. That is, in a state in which the bent region of the tear-off thread 300" is inserted into the container part 100, as the holder part 200' is coupled to the container part 100, the tear-off thread 300" may be fitted and fixed between the holder part 200' and the container part 100. Such fitting and fixing may be performed between the lower end of the container part 100 and the base 210 of the holder part 200' and/or between the inner surface of the container part 100 and the insertion part 220 of the holder part 200'.

The container 3000' illustrated in FIG. 10 is only illustrative, and various other configurations may be applied according to embodiments to which the present disclosure is applied.

Figure 11:
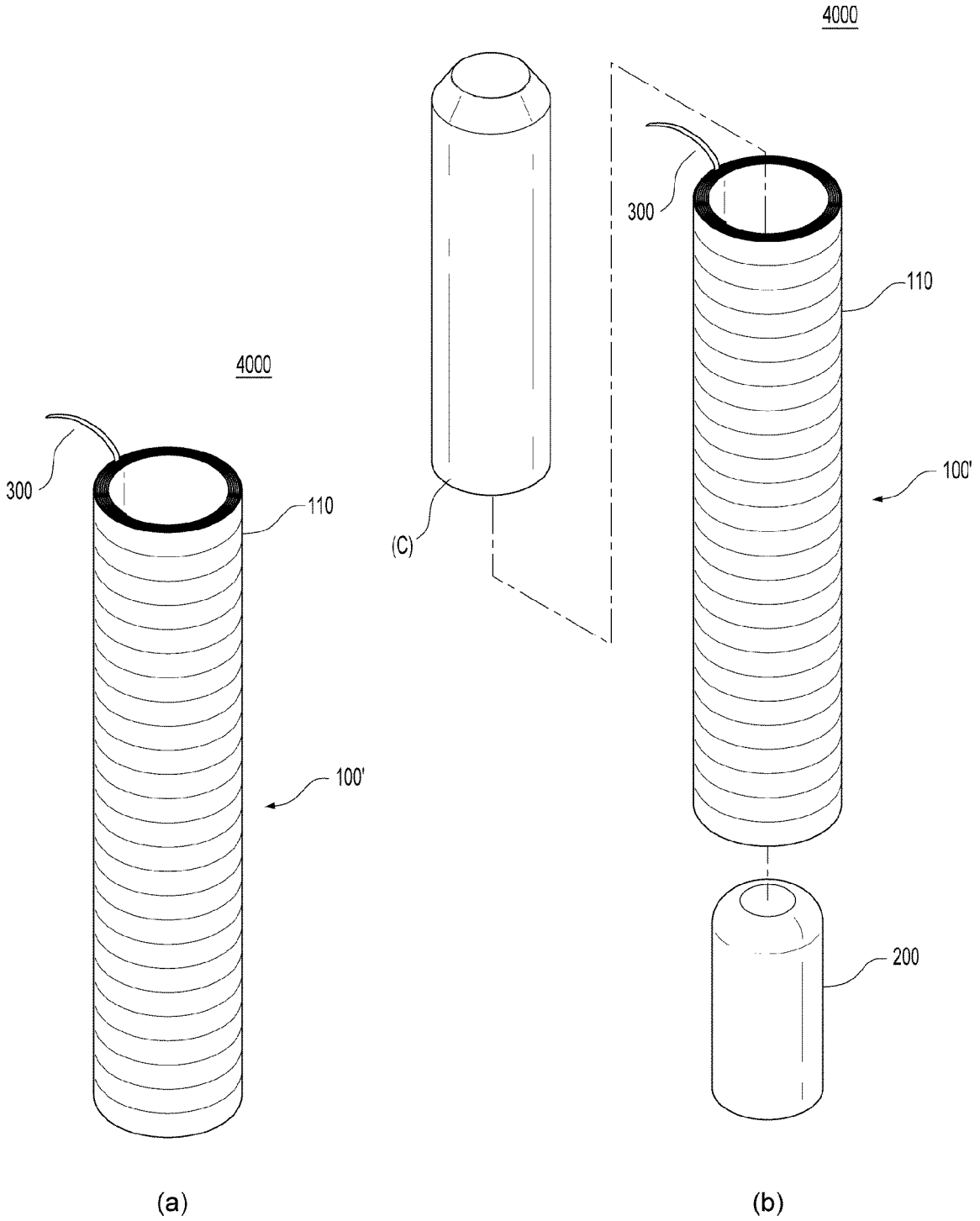
FIGS. 11 and 12 are perspective views of containers according to embodiments of the present disclosure.
Figure 12:
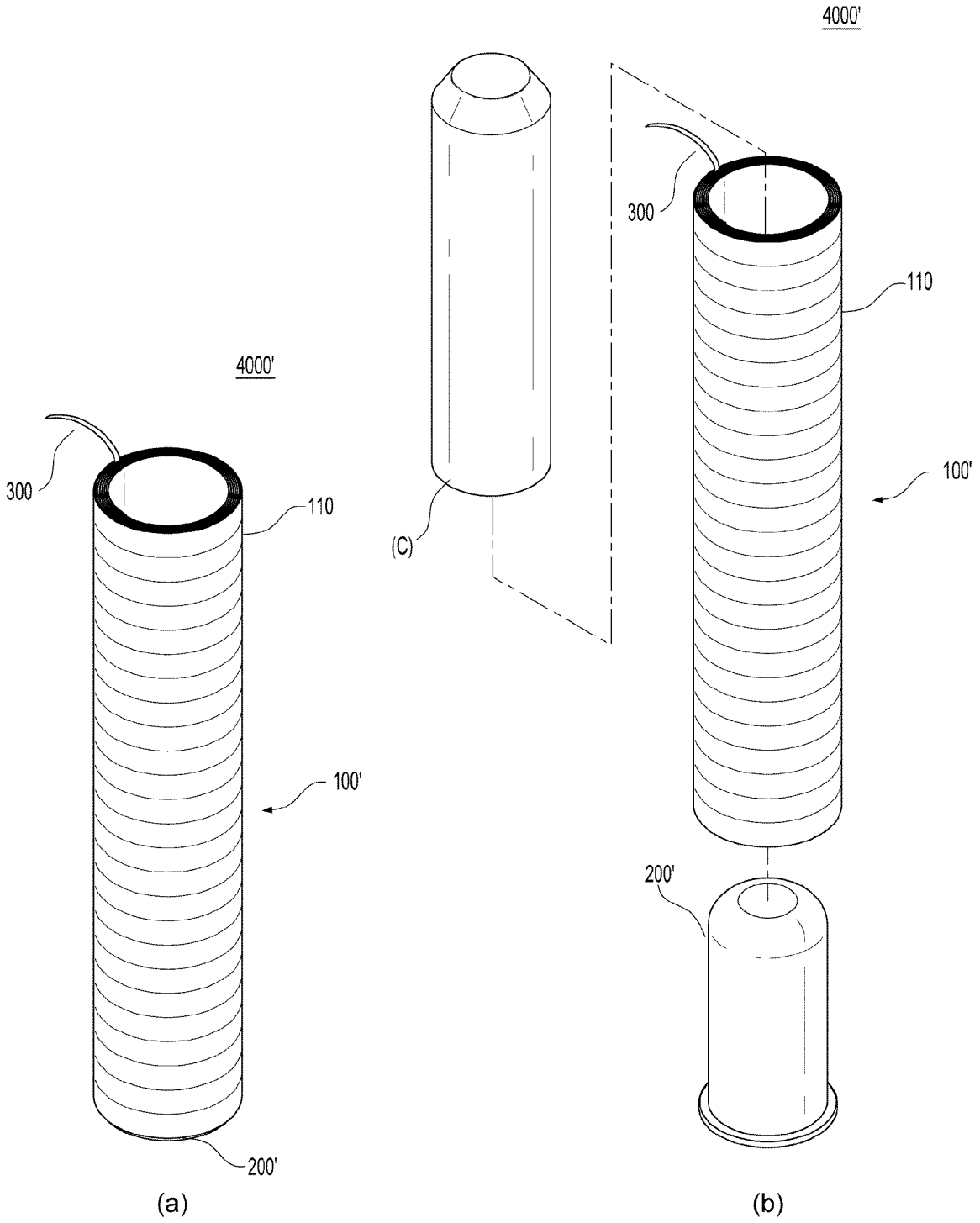

FIGS. 11 and 12 are perspective views of containers according to embodiments of the present disclosure.

Containers 4000 and 4000' of FIGS. 11 and 12 will be described below, and description overlapping with the above description of the containers 1000, 1000', 2000, 2000', 3000, and 3000' of FIGS. 1 to 10 will be omitted.

Referring to FIGS. 11 and 12, a container part 100' of the containers 4000 and 4000' may have a cylindrical shape as a whole as the packaging sheet 110 is wound in the same direction as the width direction of the packaging sheet 110.

Here, the contents C may be formed only at a predetermined depth or more from an upper end of the container part 100' instead of being formed up to the upper end of the container part 100' or being formed to protrude outward from the container part 100'.

That is, a predetermined empty space may be formed at an inner side of the upper end of the container part 100'. The containers 4000 and 4000' may be formed by tearing off the packaging sheet 110 located at the upper end of the container part 100' using the tear-off thread 300.

The containers 4000 and 4000' illustrated in FIGS. 11 and 12 are only illustrative, and various other configurations may be applied according to embodiments to which the present disclosure is applied.

Figure 13:
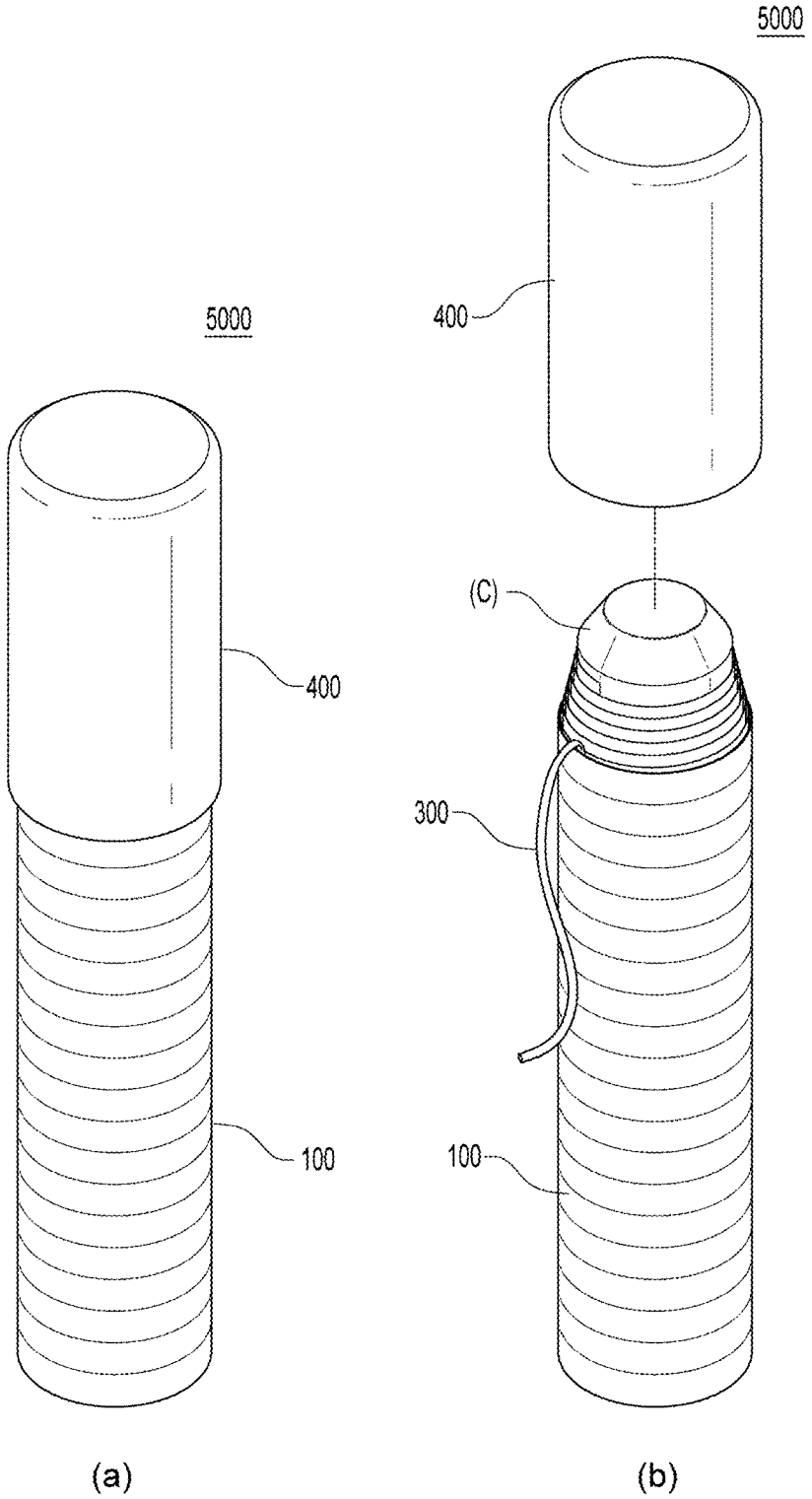
FIGS. 13 and 14 are perspective views of containers according to embodiments of the present disclosure.
Figure 14:
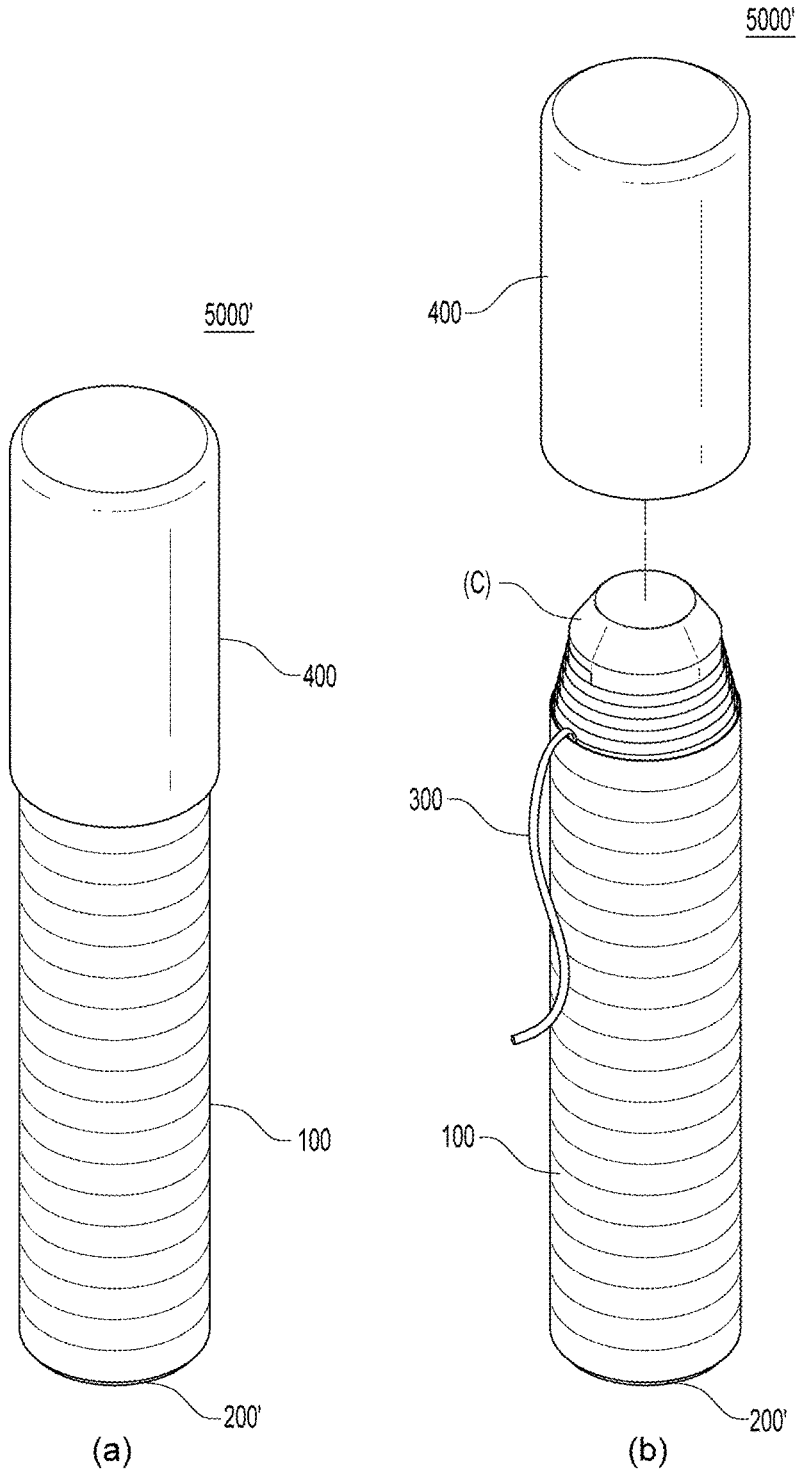

FIGS. 13 and 14 are perspective views of containers according to embodiments of the present disclosure.

Containers 5000 and 5000' of FIGS. 13 and 14 will be described below, and description overlapping with the above description of the containers 1000, 1000', 2000, 2000', 3000, 3000', 4000, and 4000' of FIGS. 1 to 12 will be omitted.

Referring to FIGS. 13 and 14, each of the containers 5000 and 5000' may further include a stopper 400 detachably coupled to the container part 100. The stopper 400 may be provided at an upper end of each of the containers 5000 and 5000', and shield contents C from the outside to prevent contamination of or damage to the contents C.

According to embodiments, the stopper 400 may be made of various materials. For example, at least one portion of the stopper 400 may be made of a material such as pulp, wood, cork, paper, or plastic. For example, at least one portion of the stopper 400 may be made of a soft material such as rubber to protect the packaging sheet 110. Also, for example, at least one portion of the stopper 400 may be made of a transparent or semi-transparent material. However, the present disclosure is not limited thereto.

In an embodiment, the stopper 400 may have the same material as the holder part 200. For example, the holder part 200 and the stopper 400 may be made of wood. Also, for example, the stopper 400 and the holder part 200 may be made of paper. In this case, the packaging sheet 110 may also be made of paper. However, the present disclosure is not limited thereto.

The containers 5000 and 5000' illustrated in FIGS. 13 and 14 are only illustrative, and various other configurations may be applied according to embodiments to which the present disclosure is applied.

Figure 15:
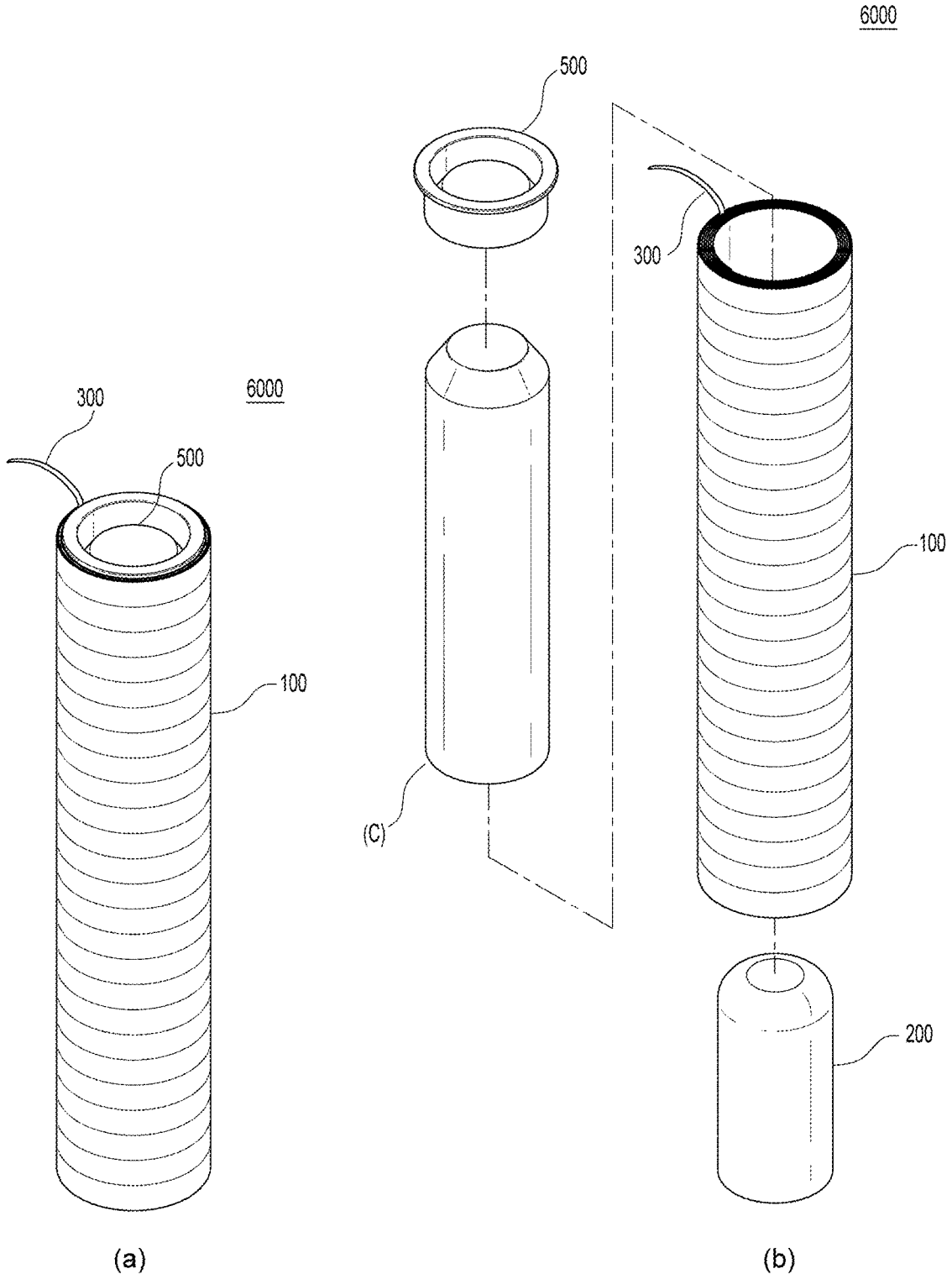
FIGS. 15 and 16 are perspective views of containers according to embodiments of the present disclosure.
Figure 16:
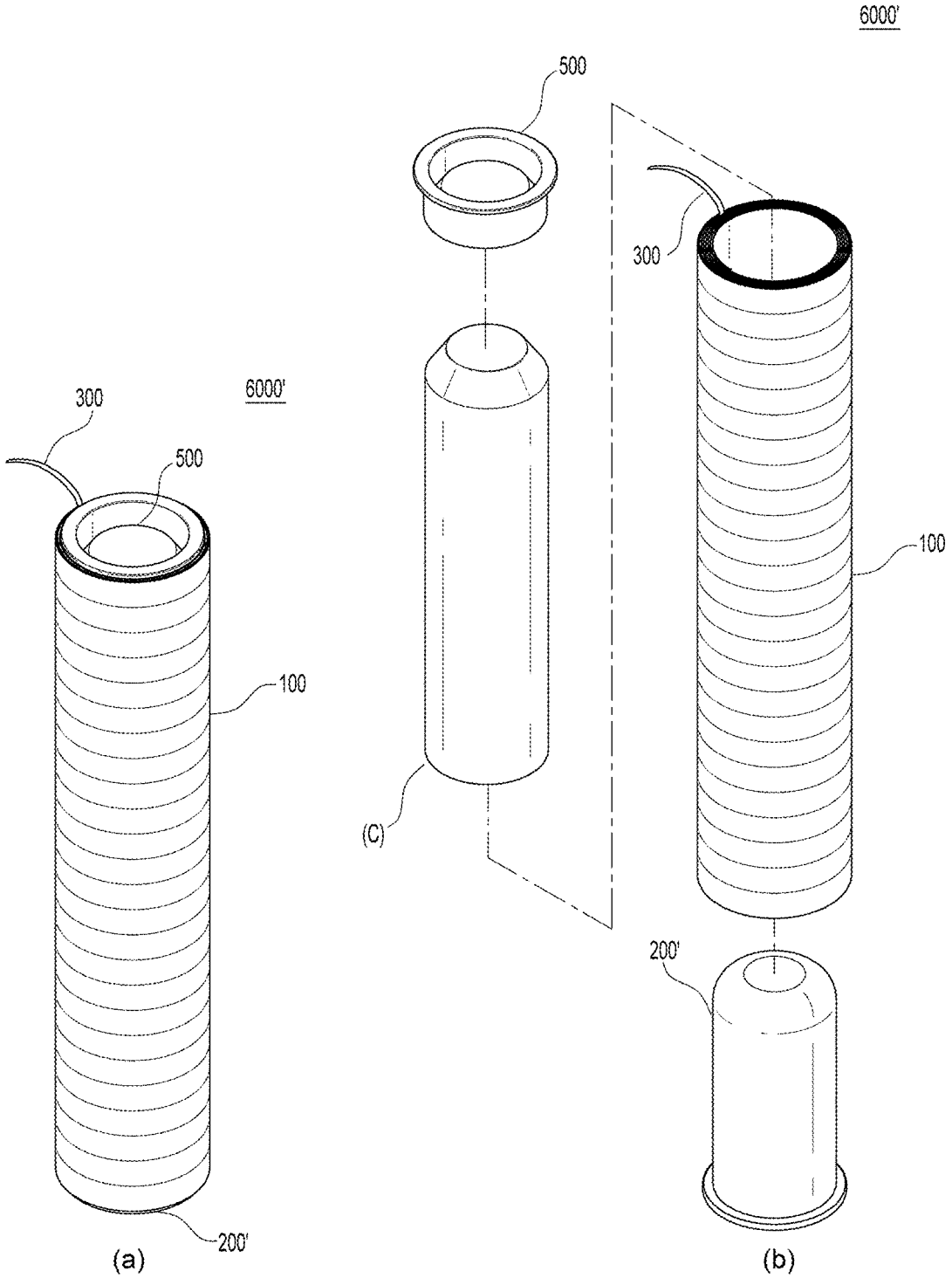

FIGS. 15 and 16 are perspective views of containers according to embodiments of the present disclosure.

Containers 6000 and 6000' of FIGS. 15 and 16 will be described below, and description overlapping with the above description of the containers 1000, 1000', 2000, 2000', 3000, 3000', 4000, 4000', 5000, and 5000' of FIGS. 1 to 14 will be omitted.

Referring to FIGS. 15 and 16, each of the containers 6000 and 6000' may further include an inner stopper 500 coupled to the container part 100. The inner stopper 500 may have at least one region inserted into the container part 100. When an empty space is formed at the upper end of the container part 100, as the inner stopper 500 is coupled to the container part 100, the inner stopper 500 may support the empty space and protect the container part 100 while protecting the contents C. The user may use the contents C after removing the inner stopper 500 and tearing off the packaging sheet 110.

Although not illustrated in FIGS. 15 and 16, according to embodiments, the containers 6000 and 6000' may further include the stopper 400 (see FIGS. 13 and 14). That is, the inner stopper 500 may protect the contents C and the container part 100 before use of the contents C, and after the inner stopper 500 is removed, the stopper 400 (see FIGS. 13 and 14) may protect the contents C while detachably coupled to the container part 100.

The containers 6000 and 6000' illustrated in FIGS. 15 and 16 are only illustrative, and various other configurations may be applied according to embodiments to which the present disclosure is applied.

Figure 17:
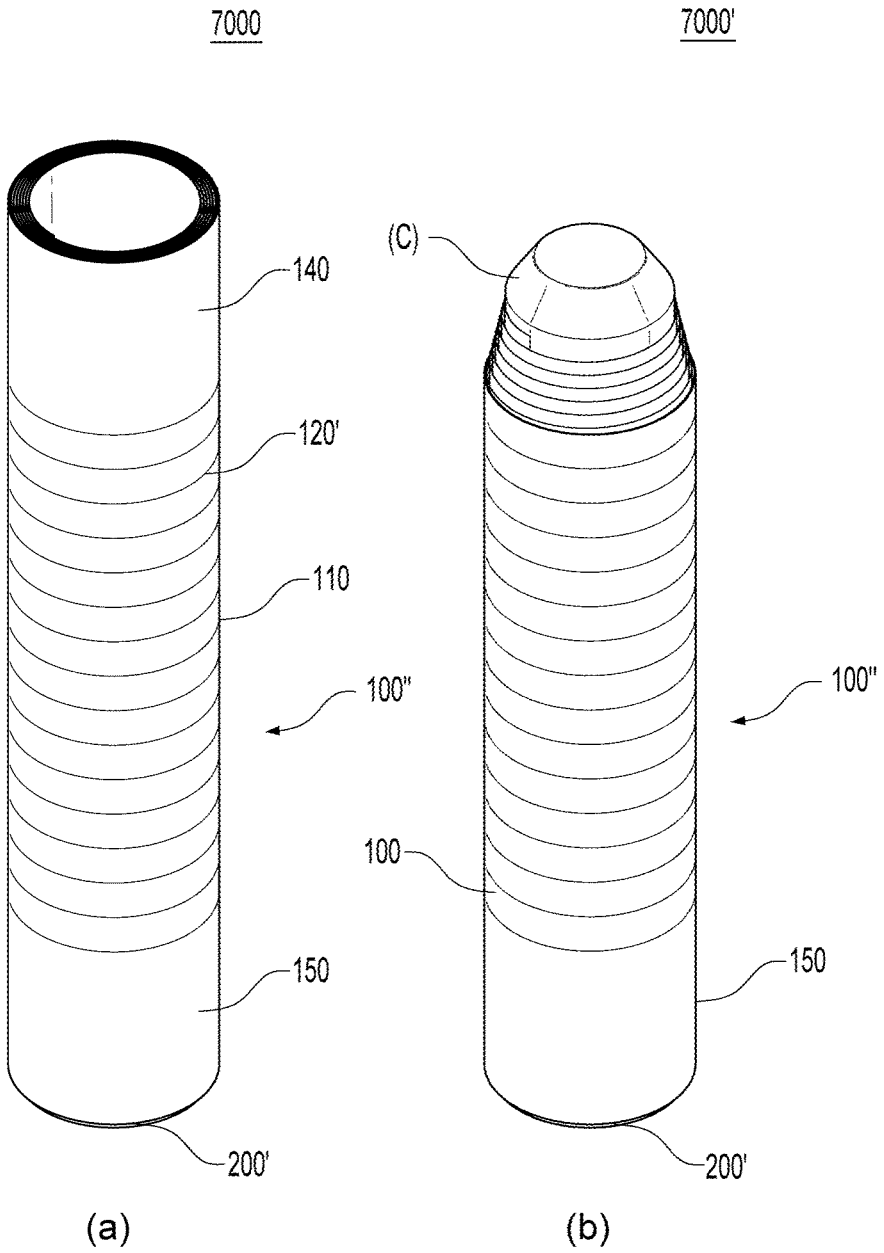
FIG. 17 is a perspective view of containers according to embodiments of the present disclosure.

FIG. 17 is a perspective view of containers according to embodiments of the present disclosure.

Containers 7000 and 7000' of FIG. 17 will be described below, and description overlapping with the above description of the containers 1000, 1000', 2000, 2000', 3000, 3000', 4000, 4000', 5000, 5000', 6000, and 6000' of FIGS. 1 to 16 will be omitted.

Referring to FIG. 17A, a tear-off thread may not be provided on a container part 100", and tearing-off may be possible using perforated lines 120'. Additionally/alternatively, the perforated lines 120' may be formed only in a predetermined region instead of being formed throughout all regions in the longitudinal direction of the container part 100". For example, the perforated lines 120' may not be formed on an upper end region and/or a lower end region of the container part 100", and accordingly, an upper end non-perforated region 140 and/or a lower end non-perforated region 150 may be formed at the upper end and/or the lower end of the container part 100".

In an embodiment, a length of the upper end non-perforated region 140 (in the longitudinal direction of the container part 100") may be larger than an interval between the perforated lines 120'. Accordingly, the packaging sheet 110 of a larger size can be separated from the container part 100" at one time through the upper end non-perforated region 140 compared to when using the perforated lines 120'. As illustrated, when the contents C do not protrude from the container part 100" and are not exposed, exposing the contents by tearing off the packaging sheet 110 may be further facilitated (see FIG. 17B).

In an embodiment, by removing the perforated lines 120' from the lower end non-perforated region 150, tearing off using the perforated lines 120' may not be performed at the lower end of the container part 100". For example, a length of the lower end non-perforated region 150 (in the longitudinal direction of the container part 100") may be larger than or equal to the length of the holder part 200' (or the insertion part of the holder part 200').

The containers 7000 and 7000' illustrated in FIG. 17 are only illustrative, and various other configurations may be applied according to embodiments to which the present disclosure is applied.

Figure 18:
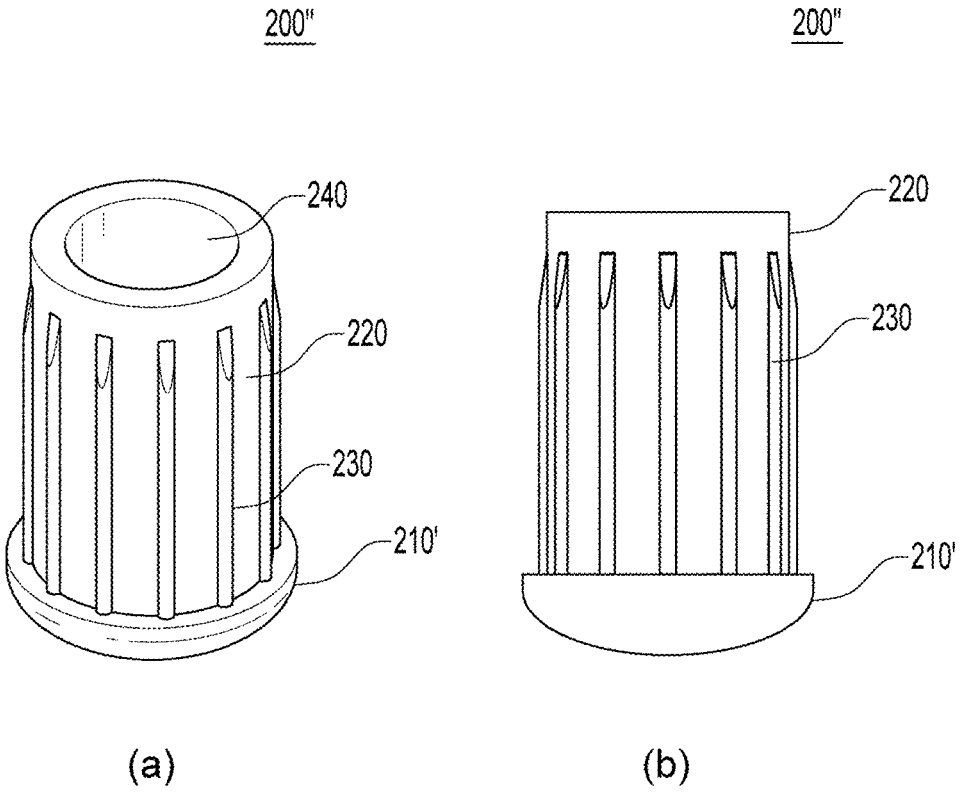
FIG. 18 is a view for describing a holder part of a container according to an embodiment of the present disclosure.

FIG. 18 is a view for describing a holder part of a container according to an embodiment of the present disclosure.

A holder part 200" of FIG. 18 may be applied to the containers 1000, 1000', 2000, 2000', 3000, 3000', 4000, 4000', 5000, 5000', 6000, 6000', 7000, and 7000' of FIGS. 1 to 17, and description overlapping with the above description will be omitted.

In an embodiment, a base 210' of the holder part 200" may be formed to be convex downward. While forming a smooth appearance, the base 210' may guide the container to stand by the upper end, the stopper 400, and/or the inner stopper 500 of the container instead of standing through the holder part 200". However, the present disclosure is not limited thereto.

In an embodiment, one or more protrusions 230 may be formed on an outer surface of the insertion part 220. The protrusions 230 may come in close contact with the inner surface of the container part and allow air in the container part to be discharged to the outside through spaces between the protrusions 230 when the holder part 200" is inserted. In this way, damage to the contents due to an internal pressure can be prevented. Also, the protrusions 230 may improve ease of assembly by reducing difficulty in an assembly process due to dimensional deviation of an inner diameter of the container part and decreasing a frictional coefficient. To this end, the protrusions 230 may each extend in the longitudinal direction (or a direction of insertion) and have a curved outer side surface. In particular, an inclined surface may be formed at an upper end of each of the protrusions 230. However, the present disclosure is not limited thereto.

In an embodiment, a recessed region 240 may be formed inward from an upper end of the insertion part 220. By the recessed region 240, the overall weight of the holder part 200" may be decreased to enhance convenience of use. Also, when the holder part 200" is inserted into the container part, the insertion part 220 may shrink inward due to the recessed region 240, and thus the holder part 200" may come in close contact with the container part. However, the present disclosure is not limited thereto.

The holder part 200" illustrated in FIG. 18 is only illustrative, and various other configurations may be applied according to embodiments to which the present disclosure is applied. For example, although the protrusions 230 are illustrated as being formed on the outer surface of the insertion part 220 in FIG. 18, the protrusions 230 may be formed on an insertion region (for example, an insertion region of the holder part 200) instead of being formed on the insertion part 220.

Figure 19:
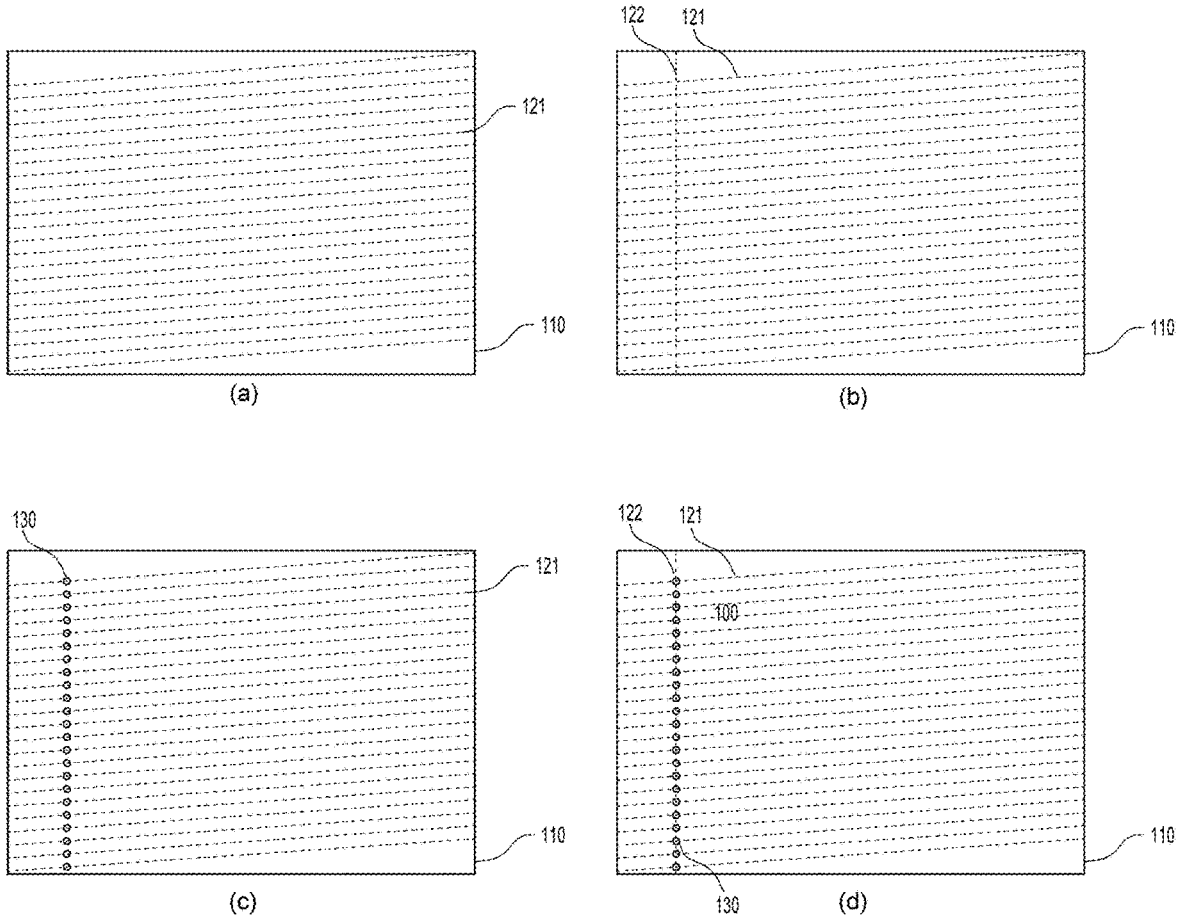
FIG. 19 is a view for describing container parts of containers according to embodiments of the present disclosure.

FIG. 19 is a view for describing container parts of containers according to embodiments of the present disclosure.

Referring to FIG. 19A, perforated lines 120 may include first perforated lines 121. The first perforated lines 121 may be formed at a predetermined slope from the width direction of the packaging sheet 110 (that is, formed in a diagonal direction). Accordingly, when the packaging sheet 110 is wound in the width direction, the first perforated lines 121 may be formed to have a helical shape along the surface of the container part 100.

Referring to FIG. 19B, perforated lines 120 may include a first perforated line 121 formed in the width direction of the packaging sheet 110 and a second perforated line 122 formed in the longitudinal direction of the packaging sheet 110. The first perforated line 121 may be provided as a plurality of first perforated lines 121 and allow the packaging sheet 110 to be torn off in the width direction, and the second perforated line 122 may be provided as at least one (in particular, one) second perforated line 122 and allow the packaging sheet 110 to be torn off in the longitudinal direction. A tear-off thread 300 may be located along the second perforated line 122, and the tear-off thread 300 may allow the packaging sheet 110 to be easily torn off along the second perforated line 122.

Referring to FIG. 19C, one or more perforations 130 may be formed in the packaging sheet 110 in the longitudinal direction thereof. When the packaging sheet 110 is wound, the perforations 130 may be formed in a layer of the packaging sheet 110 that is located at an outer side (in particular, the outermost side). A tear-off thread 300 may be located along the perforations 130, and the tear-off thread 300 may allow the packaging sheet 110 to be torn off along the perforations 130. The perforations 130 may facilitate cutting of the packaging sheet 110 using the tear-off thread 300, and simultaneously, limit units of the packaging sheet 110 being torn off using the tear-off thread 300.

Referring to FIG. 19D, perforated lines 120 may include a first perforated line 121 formed in the width direction of the packaging sheet 110 and a second perforated line 122 formed in the longitudinal direction of the packaging sheet 110. Also, one or more perforations 130 may be formed in the packaging sheet 110 in the longitudinal direction thereof. Here, the perforations 130 may be formed along the second perforated line 122, and a tear-off thread 300 may also be disposed along the second perforated line 122 and the perforations 130.

The container parts illustrated in FIG. 19 are only illustrative, and various other configurations may be applied according to embodiments to which the present disclosure is applied.

Only some embodiments have been described above with reference to the accompanying drawings, and those of ordinary skill in the art may make various modifications and changes to the above. For example, appropriate results may be achieved even when the techniques described above are performed in a different order from the methods described above, and/or the components such as systems, structures, devices, and circuits described above are coupled or combined in a different form from the methods described above or substituted with other components or their equivalents. Also, the embodiments may be carried out in combination as necessary. For example, parts of one embodiment and another embodiment of the present disclosure may be combined with each other to carry out an operation of a device. Therefore, other implementations and other embodiments equivalent to the claims below also belong to the scope of the claims.

The invention claimed is:

1. A container comprising:

a container part having a packaging sheet wound to have an accommodation space, which is configured to accommodate contents, at an inner side thereof;

a holder part having at least one region inserted into the container part to support the container part, and a tear-off thread disposed in a longitudinal direction of the container part to cut the packaging sheet in the longitudinal direction, wherein one end portion of the tear-off thread is exposed to an outer side of the packaging sheet, another end portion of the tear-off thread is inserted into the container part, and the tear-off thread is fitted and fixed by the holder part and the packaging sheet.

2. The container of claim 1, wherein an entire region of the holder part is inserted into the container part.

3. The container of claim 1, wherein the holder part includes a base and an insertion part protruding from the base and inserted into the container part.

4. The container of claim 1, wherein at least one portion of the holder part has an expandable/contractable material, and the at least one portion is configured to expand after the at least one portion is inserted into the container part in a state in which a volume of the at least one portion is reduced.

5. The container of claim 1, wherein a plurality of breakage parts spaced from each other are disposed at the tear-off thread to facilitate cutting of the tear-off thread.

6. The container of claim 1, wherein the container part further includes a first perforated line defined in the packaging sheet in a width direction thereof.

7. The container of claim 6, wherein the container part further includes a second perforated line defined in the packaging sheet in a longitudinal direction thereof.

8. The container of claim 1, further comprising:

an inner stopper having at least one region inserted into the container part; and a stopper detachably coupled to the container part.

9. The container of claim 1, wherein the contents are a solid composition obtained by filling the accommodation space with the contents in a fluid state and hardening the contents.

10. The container of claim 9, wherein the contents have a hardness ranging from 20 to 150 dyne/cm$^2$.

11. The container of claim 10, wherein the contents have a shrinkage rate of less than 20% when hardened.

12. The container of claim 1, wherein the tear-off thread is fitted and fixed between an inner surface of the container part and an outer surface of the holder part.

13. The container of claim 1, wherein the holder part includes a base and an insertion part defined to protrude from the base and inserted into the container part; and wherein another end portion of the tear-off thread is fitted and fixed between an inner surface of the container part and the insertion part of the holder part.

14. The container of claim 1, wherein the holder part includes a base and an insertion part defined to protrude from the base and inserted into the container part; and another end portion of the tear-off thread is fitted and fixed between a lower end of the container part and the base of the holder part.

15. The container of claim 1, wherein the holder part includes a base and an insertion part defined to protrude from the base and inserted into the container part; and another end portion of the tear-off thread is fitted and fixed between an inner surface of the container part and the insertion part of the holder part, and between a lower end of the container part and the base of the holder part.

* * * * *